US009929480B1

(12) United States Patent
Wu

(10) Patent No.: US 9,929,480 B1
(45) Date of Patent: Mar. 27, 2018

(54) SHIELDED KEYSTONE JACK STRUCTURE

(71) Applicant: HSING CHAU INDUSTRIAL CO., LTD., Taipei (TW)

(72) Inventor: Kei-Wei Wu, Taipei (TW)

(73) Assignee: HSING CHAU INDUSTRIAL CO., LTD., Taipei (TW)

( * ) Notice: Subject to any disclaimer, the term of this patent is extended or adjusted under 35 U.S.C. 154(b) by 0 days.

(21) Appl. No.: 15/678,570

(22) Filed: Aug. 16, 2017

(51) Int. Cl.

| | |
|---|---|
| ***H01R 4/58*** | (2006.01) |
| ***H01R 9/03*** | (2006.01) |
| ***H01R 4/24*** | (2018.01) |
| ***H01R 13/6592*** | (2011.01) |
| ***H01R 13/58*** | (2006.01) |

(52) U.S. Cl.
CPC ..... *H01R 9/031* (2013.01); *H01R 4/2445* (2013.01); *H01R 13/5833* (2013.01); *H01R 13/6592* (2013.01)

(58) Field of Classification Search
CPC ..... H01R 13/53; H01R 13/65802; H01R 13/6272; H01R 43/24; H01R 23/025
USPC ..... 439/88, 607.01, 941, 354, 606, 676
See application file for complete search history.

(56) References Cited

U.S. PATENT DOCUMENTS

| | | | | |
|---|---|---|---|---|
| 8,192,224 | B2 * | 6/2012 | Schmidt | H01R 24/64 439/409 |
| 8,303,314 | B2 * | 11/2012 | Wu | H01R 9/032 29/860 |
| 2005/0159047 | A1 * | 7/2005 | Takahashi | H01R 9/032 439/607.41 |
| 2007/0270036 | A1 * | 11/2007 | Belopolsky | H01R 9/032 439/607.41 |

* cited by examiner

*Primary Examiner* — Phuong Chi T Nguyen
(74) *Attorney, Agent, or Firm* — WPAT, PC

(57) ABSTRACT

Shielded keystone jack structure is for connection of a plurality of wires of a first cable to be terminated to a second cable. The shielded keystone jack structure includes a front housing, terminal connection unit, wire organizer, cover, and rear housing. The front housing includes a front portion having an opening for insertion of the second cable; and an accommodation portion. The terminal connection unit has wire contacts, piercing terminals, a first guiding element, and first positioning parts. The wire organizer having wire-receiving slots for attachment of the wires thereto, as disposed on the terminal connection unit carried by the front housing, is moved towards the piercing terminals along a path at least defined by the first guiding elements and first positioning parts for termination of the wires when the cover is pivoted to a closed position. The rear housing is used for being attached to the front housing.

19 Claims, 23 Drawing Sheets

30

B-B

50

55

SHIELDED KEYSTONE JACK STRUCTURE

FIELD OF THE INVENTION

The present invention relates to a shielded keystone jack structure.

BACKGROUND OF THE INVENTION

Over the past few years, advances in network transmission have facilitated an explosive increase in data transmission rate. Now, the most up-to-date system deployed in horizontal cabling is Augmented Category 6 system (Cat 6A). Regarding Cat 6A, it is recommended to install shielded system instead of unshielded since shielded cabling does have outstanding immunity to electromagnetic interference from external sources, so as to provide balanced cabling.

The cable for shielded Cat 6A system has larger conductor and insulation than that for the unshielded Cat 6A system. An impact tool is generally required for punching down the wires of the cables into the jacks for shielded or unshielded systems. It is desirable to provide a shielded jack that features toolless design so that the four twisted-pair of a cable can be readily terminated at one time.

In addition, the standard does require horizontal cable to be solid 23AWG in order to prevent the attenuation. However, in telecommunication room, people sometimes might use stranded 26AWG patch cable with one end terminated with modular plug, with the other end terminated with keystone jack. Hence, it is desirable to have a shielded keystone jack capable of supporting not only solid 23AWG (bigger) cable, but also stranded 26AWG (smaller) cable.

It is well known that the shielded system has better external electromagnetic interference immunity than the unshielded system. There is still room for improvement in prevention of electromagnetic leakage.

SUMMARY OF THE INVENTION

It is an objective of the present invention to provide shielded keystone jack structure to facilitate cable termination.

To achieve the foregoing objective, the present invention provides a keystone jack structure for connection of a plurality of wires of a first cable to be terminated to a second cable, the keystone jack structure comprising: a front housing, a terminal connection unit, a wire organizer, a cover, and a rear housing. The front housing includes a front portion and an accommodation portion, the front portion having an opening for insertion of the second cable. The terminal connection unit has a plurality of wire contacts, a plurality of piercing terminals electrically coupled to the respective wire contacts, a first guiding element, and a plurality of first positioning parts arranged among the piercing terminals, wherein the wire contacts are disposed on the front portion and the piercing terminals are disposed on the accommodation portion when the terminal connection unit is carried by the front housing. The wire organizer has a plurality of wire-receiving slots for attachment of the plurality of wires thereto. The cover is pivotally connectable to the front housing. The wire organizer, when being disposed on the terminal connection unit carried by the front housing, is moved towards the piercing terminals along a path at least defined by the first guiding elements and the first positioning parts so that the wires attached to the wire organizer are terminated to the respective piercing terminals when the cover is pivoted from an open position to a closed position. The rear housing is used for being attached to the front housing so as to cover at least one side of the terminal connection unit carried by the front housing.

In an embodiment, the first guiding element is disposed between the wire contacts and the piercing terminals, and at least two of the first positioning parts are disposed adjacent to opposite lateral sides of the terminal connection unit.

In an embodiment, the first guiding element is disposed between the wire contacts and the piercing terminals and has a top section; the front portion of the front housing has a bearing section; the bearing section and the top section form a bearing for pivotal connection between the cover and the front housing when the terminal connection unit is carried by the front housing.

In an embodiment, the wire organizer further has: a second guiding element for engaging with the first guiding element; and a plurality of second positioning parts for engaging with the first positioning parts.

In an embodiment, the keystone jack structure further includes: a grounding bracket, pivotally connected to the rear housing, for electrically connecting to a shield portion of the first cable, wherein the grounding bracket is conductive and resilient.

In an embodiment, the grounding bracket includes: a grounding contact surface for connection to the shield portion of the first cable; a bearing portion, extending from the grounding contact surface and being curved, for being pivotally connected to the rear housing; and a support portion, extending from the bearing portion and shaped into folds, for being in contact with the rear housing to exert a force on the grounding contact surface inwards.

In an embodiment, the grounding bracket further includes: a motion limiting portion, extending from the support portion, having a slot for engaging with the rear housing.

In an embodiment, the rear housing includes: a cover portion for engagement with the front housing so as to cover at least one side of the terminal connection unit carried by the front housing; and a holding portion, connected to the cover portion, having: a pivot for making a pivot connection with the bearing portion, a support surface for being in contact with the support portion, and a protrusion for engaging with the slot of the motion limiting portion to control motion of the grounding bracket with respect to the pivot connection.

In an embodiment, the holding portion further has a groove across the support surface in order for a fastener to pass the groove and fasten the holding portion and the cover so that the shield portion of the first cable is connected to the grounding bracket securely.

In an embodiment, one of the wire-receiving slots is open to a peripheral side of the wire organizer and has a first end and a second end on an outer face and an inner face of the wire organizer, respectively, the outer face is opposite the inner face, and the first end has a spacing which is different from that of the second end so as to facilitate accommodation of one of the wires.

In an embodiment, the first end is an omega-shaped opening.

In an embodiment, the second end is a canyon-shaped opening.

In an embodiment, the wire organizer comprises: a wire-receiving body having a cavity for receiving the wires to be terminated; and a plurality of wire-receiving portions, coupled to lateral sides of the wire-receiving body, each of the wire-receiving portions having at least one the wire-receiving slots; wherein each of the wire-receiving slots is open to a peripheral side of the corresponding wire-receiving portion and has a first end and a second end on an outer face and an inner face of the corresponding wire-receiving portion, respectively, the outer face is opposite the inner face, and the first end has a spacing which is different from that of the second end so as to facilitate accommodation of one of the wires.

In an embodiment, the wire organizer further comprises: a second guiding element, disposed on the wire-receiving body, for engaging with the first guiding element; and a plurality of second positioning parts, coupled to the lateral sides of the wire-receiving body, for engaging with the first positioning parts.

In an embodiment, the terminal connection unit includes: an insulation base; a circuit board, disposed on the insulation base, wherein the wire contacts and the piercing terminals are disposed on the circuit board; and a terminal connection housing for covering the circuit board partially, wherein the first guiding element and the first positioning parts are disposed on the terminal connection housing and the terminal connection housing has openings through which the wire contacts and the piercing terminals are exposed at least partially.

In an embodiment, the insulation base has a first securing arm which is resilient and for engaging with an interior sidewall of the accommodation portion of the front housing so as to secure the insulation base to the front housing.

In an embodiment, the insulation base has a second securing arm which is resilient and for engaging with a bottom plate of the front housing so as to secure the insulation base to the front housing.

In an embodiment, the insulation base has a third securing arm which is resilient and for engaging with the rear housing so as to secure the rear housing to the insulation base.

In an embodiment, the first guiding element is disposed between the wire contacts and the piercing terminals on the terminal connection housing and has a top section; the front portion of the front housing has a bearing section; the bearing section and the top section form a bearing for pivotal connection between the cover and the front housing when the terminal connection unit is carried by the front housing.

DETAILED DESCRIPTION OF THE PREFERRED EMBODIMENTS

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
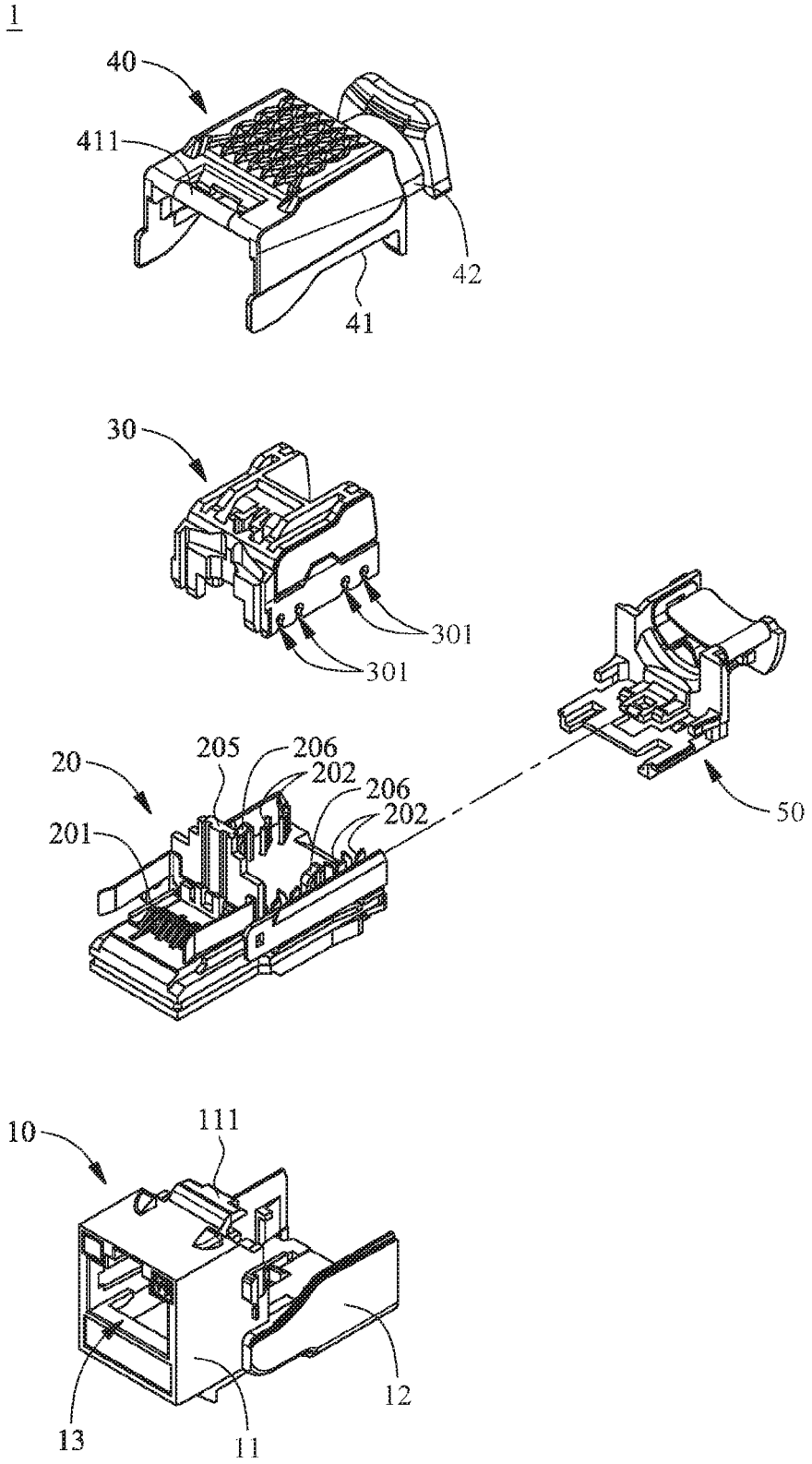
FIG. 1 is an exploded view of a shielded keystone jack structure according to an embodiment of the invention.
Figure 2A:
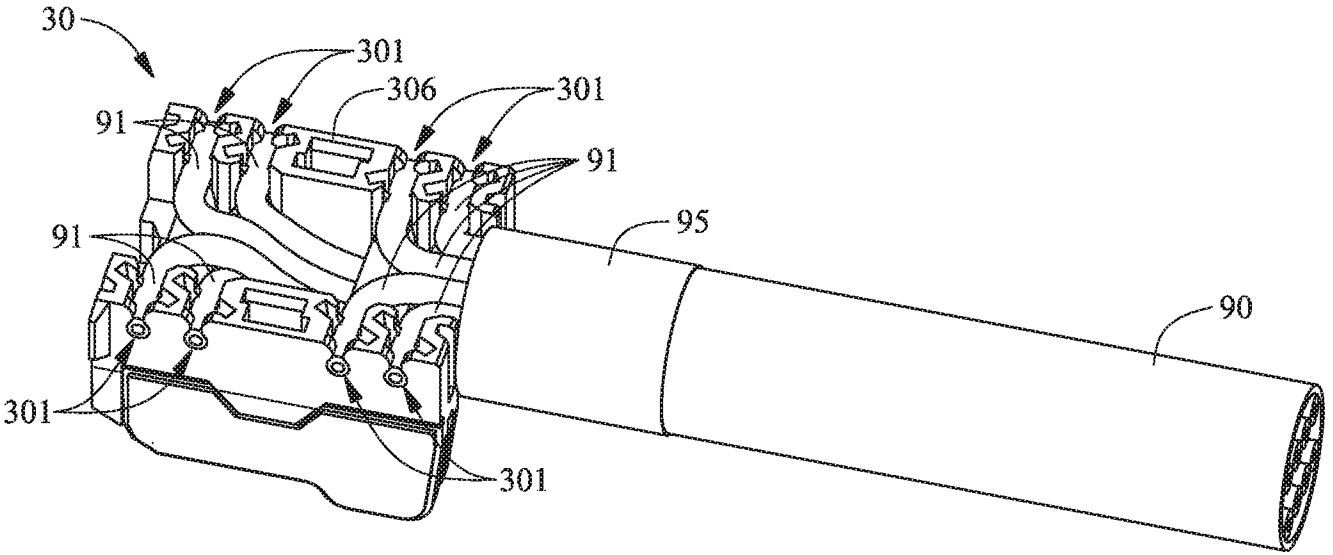
FIGS. 2A-2D are schematic views illustrating a shielded keystone jack to which a shielded cable is terminated.
Figure 2B:
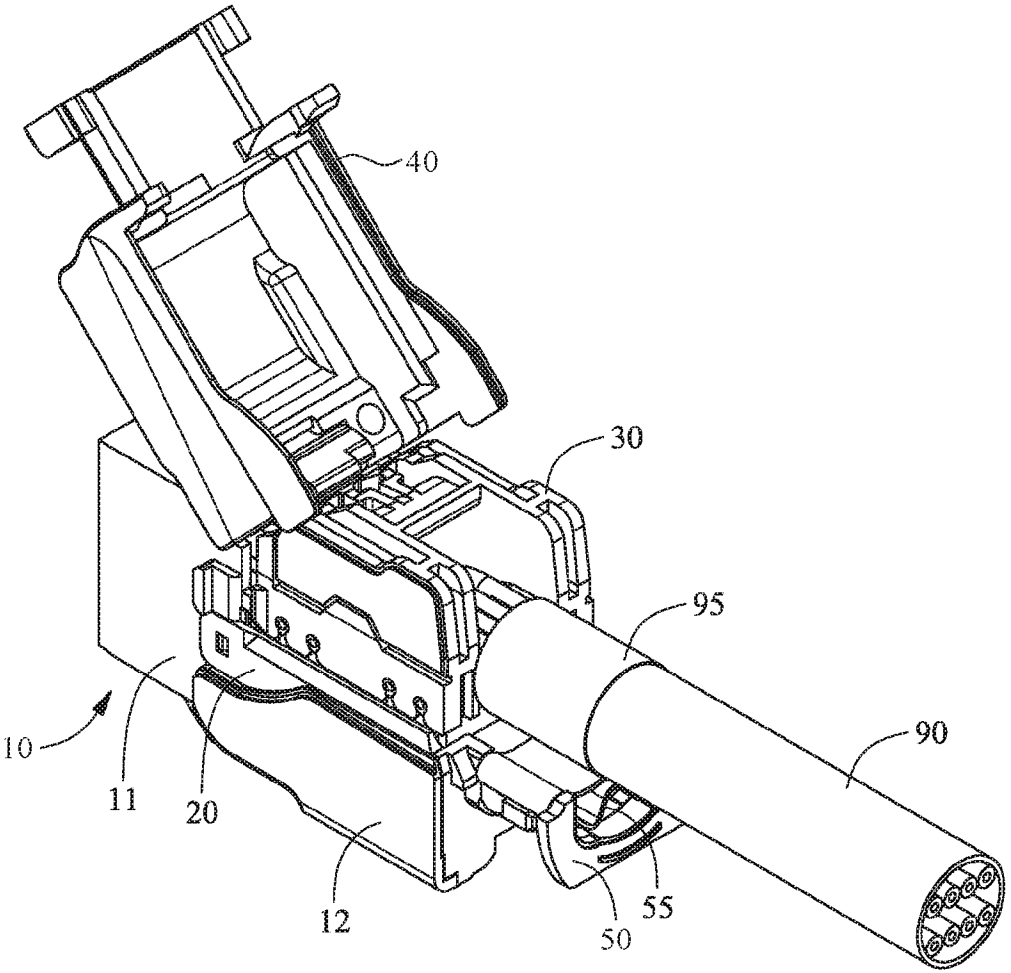
Figure 2C:
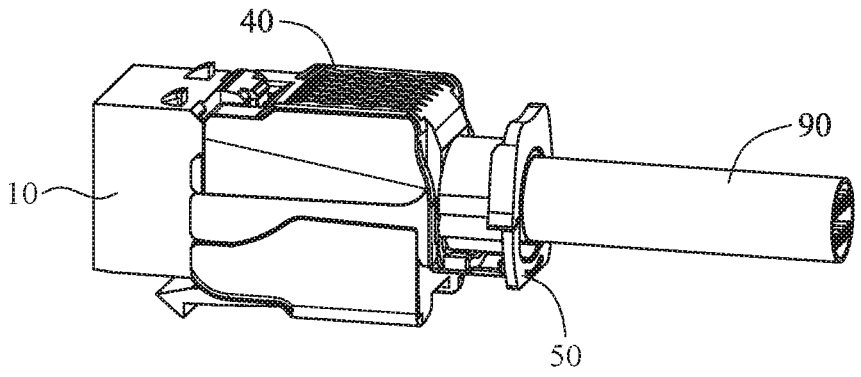
Figure 2D:
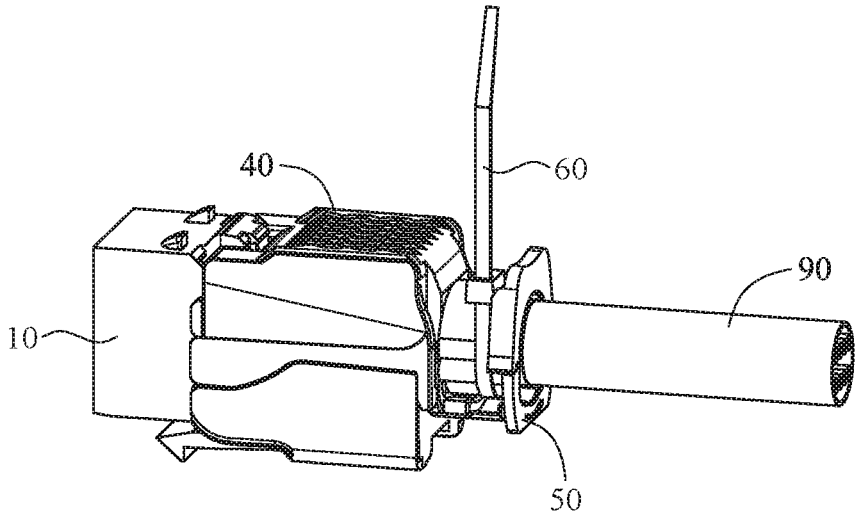

FIGS. 1-2D shows a keystone jack structure 1 according to an embodiment of the invention. As illustrated in an exploded view in FIG. 1, a shielded keystone jack structure 1 comprises a front housing 10, a terminal connection unit 20, a wire organizer 30, a cover 40, and a rear housing 50. The keystone jack structure 1 is utilized for connection of a first cable to be terminated to a second cable (not shown), wherein the first cable may be referred to as a cable to be installed and the second cable may be a patch cable, for example.

The front housing 10 includes a front portion 11 and an accommodation portion 12. The front portion 11 has an opening for insertion of the second cable.

The terminal connection unit 20 has a plurality of wire contacts 201, a plurality of piercing terminals 202, a first guiding element 205, and a plurality of first positioning parts 206. The piercing terminals 202 are electrically coupled to the respective wire contacts 201. The first positioning parts 206 are arranged among the piercing terminals 202. The wire contacts 201 are disposed on the front portion 11 and the piercing terminals 202 are disposed on the accommodation portion 12 when the terminal connection unit 20 is carried by the front housing 10. For example, the front housing 10 can be constructed in a way that the terminal connection unit 20 can be inserted into the front portion 11 and the accommodation portion 12.

The wire organizer 30 has a plurality of wire-receiving slots 301 for attachment of the plurality of wires thereto.

The cover 40 is pivotally connectable to the front housing 10. The cover 40 includes a first covering portion 41 and a second covering portion 42. When the cover 40 is pivoted to a closed position, the first covering portion 41 covers the wire organizer 30 disposed on the terminal connection unit 20 carried by the front housing 10, and the second covering portion 42 covers a portion of the first cable terminated to the terminal connection unit 20.

The rear housing 50 is used for being attached to the front housing 10 so as to cover at least one side of the terminal connection unit 20 carried by the front housing 10.

The wire organizer 30, as being disposed on the terminal connection unit 20 carried by the front housing 10, is moved towards the piercing terminals 202 along a path at least defined by the first guiding element 205 and the first positioning parts 206 so that the wires attached to the wire organizer 30 are terminated to the respective piercing terminals 202 when the cover 40 is pivoted from an open position to a closed position. The wire organizer 30 can be removably disposed on the terminal connection unit 20 carried by the front housing 10 as the cover 40 is pivoted to an open position, where the cover 40 is not in contact with the wire organizer 30. In the closed position of the cover 40, the wire organizer 30 is covered and cannot be seen.

Referring to FIGS. 2A-2D, a shielded cable 90 is to be terminated with a shielded keystone jack based on FIG. 1. For cable termination, the cable jacket of an end of the shielded cable 90 is first stripped and the shield portion 95 of the shielded cable 90, such as the screened braid and/or foil, is pulled back along the cable jacket. As illustrated in FIG. 2A, the wires 91 of the shielded cable 90 are seated into the wire-receiving slots 301 of the wire organizer 30 according to a designated wiring scheme. The wire-loaded wire organizer 30 can be loosely disposed on the terminal connection unit 20 carried by the front housing 10, as shown in FIG. 2B. When the cover 40 is pivoted from an open position, as in FIG. 2B, to a closed position, as in FIG. 2C, the wire organizer 30 is pressed and moved towards the piercing terminals 202 along a path at least defined by the first guiding element 205 and the first positioning parts 206, and the wires 91 attached to the wire organizer 30 are finally terminated to the respective piercing terminals 202. In addition, for cable shield grounding, the shield portion 95 of the shielded cable 90 can be connected to a conductive part of the shielded keystone jack, which can be electrically coupled to the ground. For example, the shield portion 95 of the shielded cable 90 can be electrically coupled to the cover 40 and the rear housing 50 tightly through a grounding bracket 55 with a fastener 60, such as a cable tie or so on, wherein at least one of the cover 40, front housing 10, and rear housing 50, in part or whole, is conductive; but the invention is not limited to this example. Embodiments of the grounding bracket 55 will be provided later.

The keystone jack structure 1 according to the embodiment of FIG. 1 is configured to facilitate relative movement between the wire organizer 30 and the terminal connection unit 20 along a path at least defined by the first guiding element 205 and the first positioning parts 206. In other words, at least three components of the terminal connection unit 20 control the relative movement.

Figure 3:
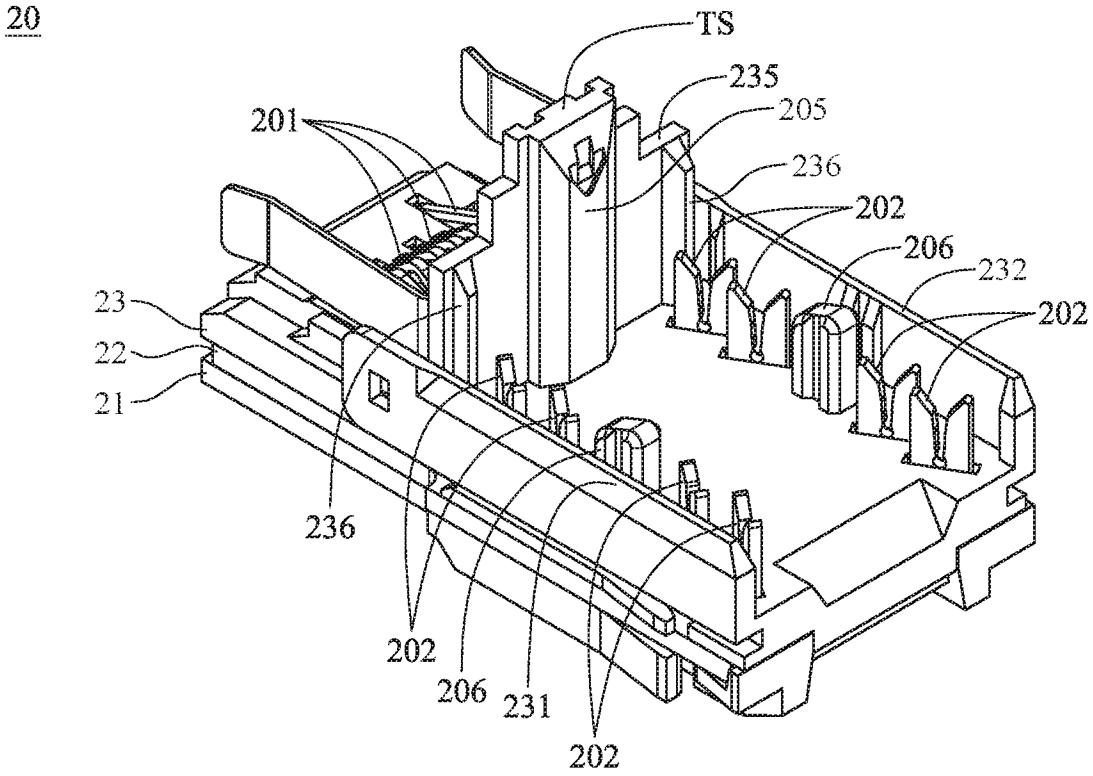
FIG. 3 is a schematic view of a terminal connection unit according to an embodiment of the invention.

In an embodiment, a shielded keystone jack according to FIG. 1 is provided with a linear path to facilitate direction changing of a force exerted on the cover 40 and reduction of friction forces when relative movement exists between the wire organizer 30 and the terminal connection unit 20, thereby making the cable termination readily. In the present embodiment of the shielded keystone jack, a terminal connection unit 20 as exemplified in FIG. 3 has: the first guiding element 205 disposed between the wire contacts 201 and the piercing terminals 202, and at least two of the first positioning parts 206 disposed adjacent to opposite lateral sides 231 and 232 of the terminal connection unit 20. For example, the first guiding element 205 and the first positioning parts 206 can be implemented as columns, cylinders, or dowels with same or respective shapes, in protrusion manner. As an instance shown in FIG. 3, the first guiding element 205 can be formed or disposed on a guiding wall 235 where one or more additional guiding element 236 may be configured; or the first guiding element 205 can be extended as the guiding wall 235; and the invention is not limited thereto.

Figure 4:
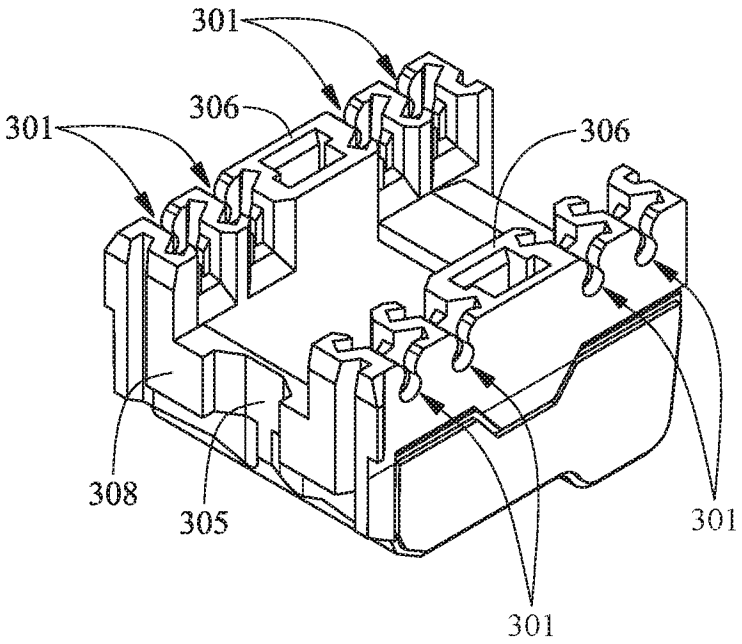
FIG. 4 is a schematic view of a wire organizer according to an embodiment of the invention.

Also in the present embodiment of the shielded keystone jack, a wire organizer 30, as exemplified in FIG. 4, further has: a second guiding element 305 for engaging with the first guiding element 205; and a plurality of second positioning parts 306 for engaging with the first positioning parts 206. For example, the second guiding element 305 and second positioning parts 306 can be implemented as components with same or respective recessed shapes. As an instance shown in FIG. 4, the second guiding element 305 is a recessed or curved portion disposed on a guiding wall 308, and the second positioning parts 306 have respective recessed holes or dowel holes.

Figure 5A:
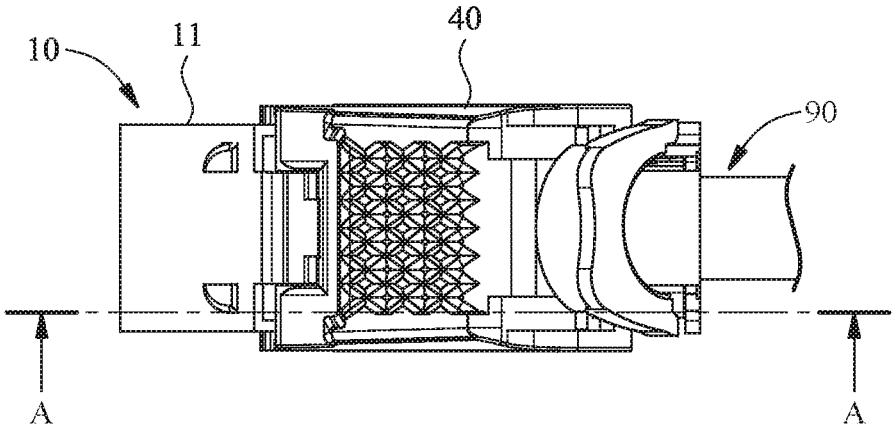
FIGS. 5A-5B illustrate a shielded keystone jack in which the wire organizer is disposed on the accommodation portion and the cover is pivoted to an intermediate position, in a top view and a cross-sectional view respectively.
Figure 5B:
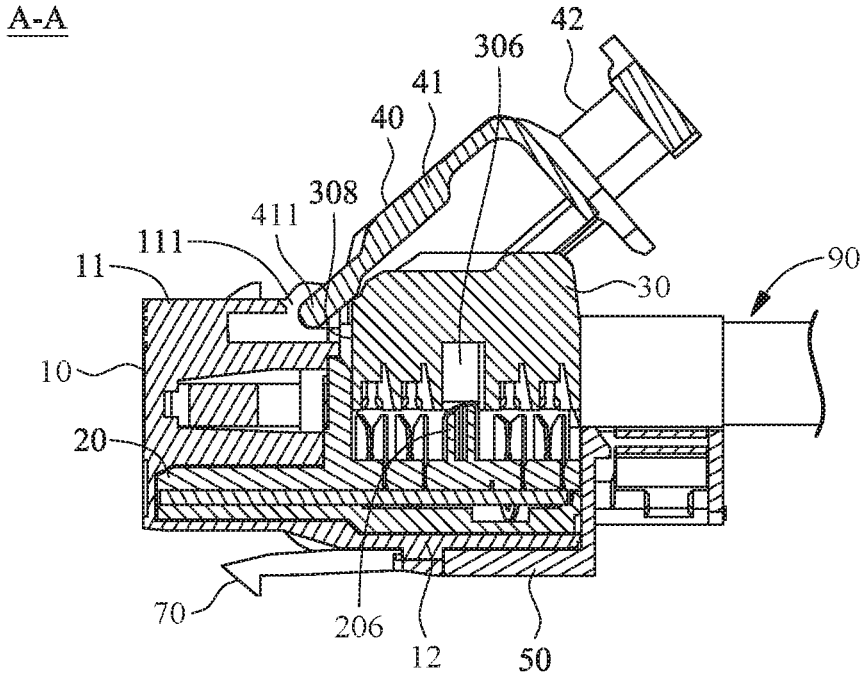
Figure 6A:
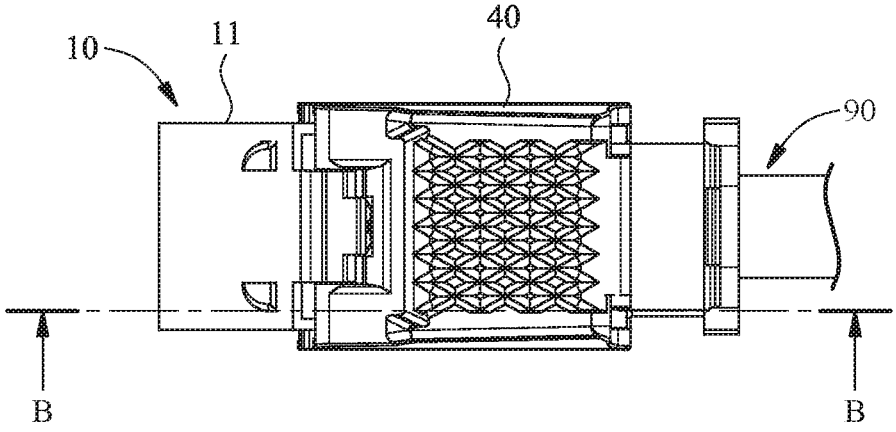
FIGS. 6A-6B illustrate the shielded keystone jack in which wires attached to the wire organizer are terminated to the piercing terminals and the cover is pivoted to a closed position, in a top view and a cross-sectional view respectively.
Figure 6B:
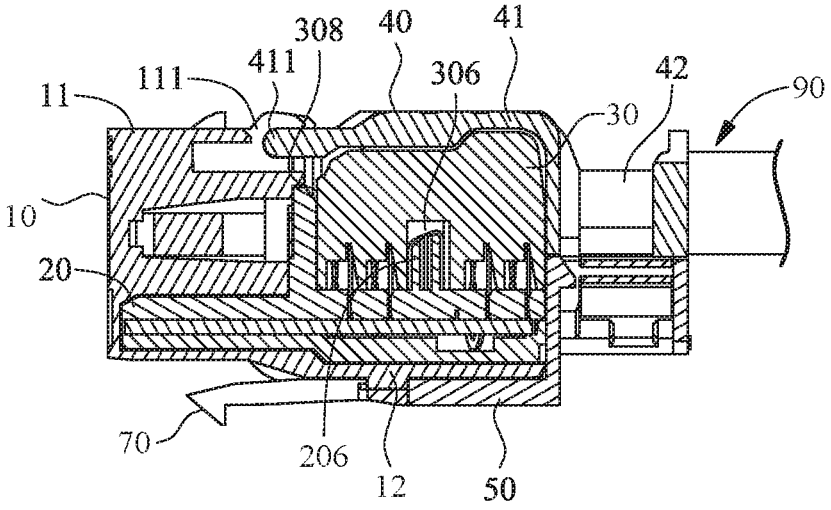

Referring to FIGS. 5A and 5B, the shielded keystone jack of the present embodiment is illustrated in a top view and a cross-sectional view along line A-A respectively, wherein the wire organizer 30 to which the wires of the shielded cable 90 are attached is being loosely disposed on the terminal connection unit 20 and the cover 40 is pivoted to an intermediate position, where the cover 40 is in contact with the wire organizer 30. For the sake of brevity, the wires attached to the wire organizer 30 will not be shown in FIG. 5B and so on; and an illustrative example of such attachment can be found in FIGS. 2A and 2B. Referring to FIGS. 6A and 6B, the shielded keystone jack of the present embodiment is illustrated in a top view and a cross-sectional view along line B-B respectively, wherein the wires attached to wire organizer 30 are terminated to the piercing terminals 202 and the cover 40 is pivoted to a closed position, in a top view and a cross-sectional view respectively. As can be observed from FIGS. 5A to 6B, the wire organizer 30 is moved towards the piercing terminals 202 along a linear path at least defined by the first guiding element 205 and the first positioning parts 206 so that the wires attached to the wire organizer 30 are terminated to the respective piercing terminals 202 when the cover 40 is pivoted to the closed position.

Figure 7A:
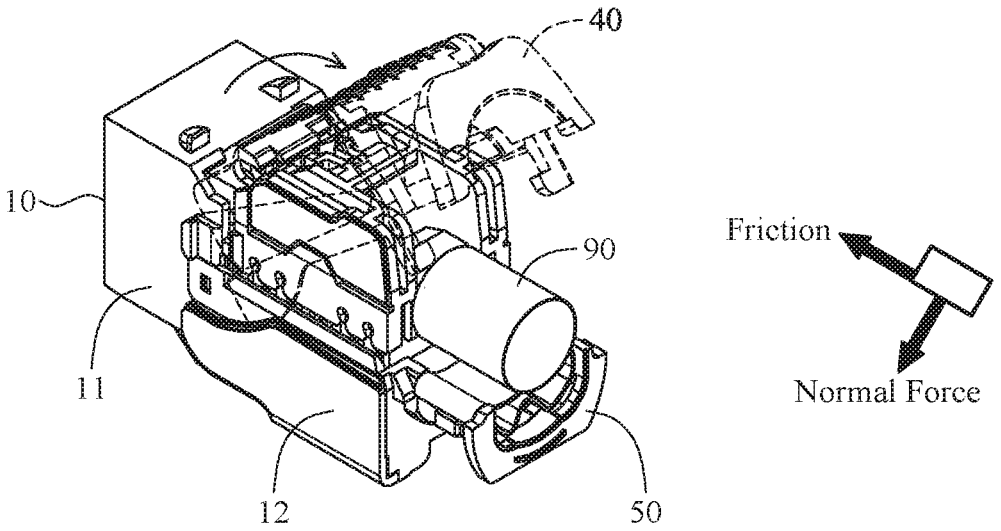
FIGS. 7A-7B are schematic graphs showing the orientations of normal force.
Figure 7B:
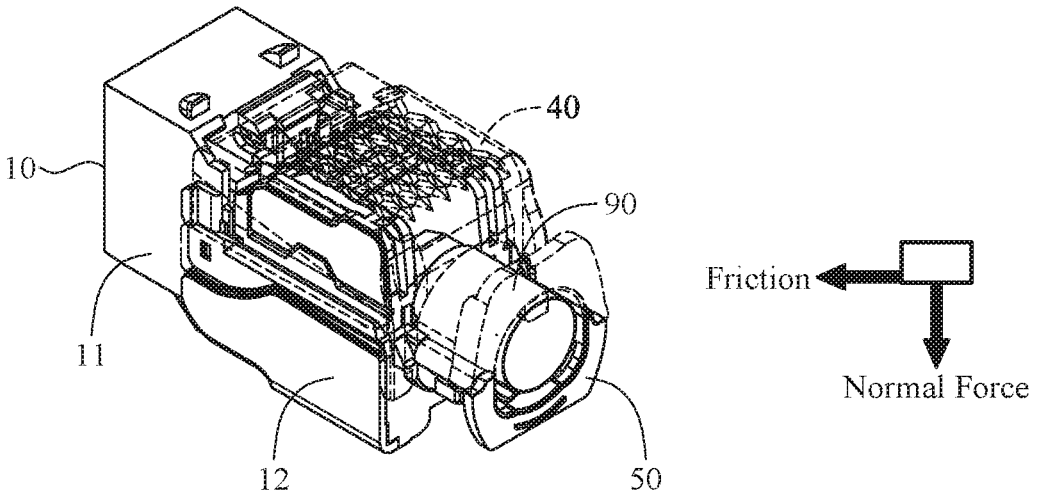

As illustrated in FIG. 7A, if the user presses the cover 40 in an angled path, the force exerted by the user on the cover 40 and wire organizer 30 is not vertical so the friction force becomes greater. However, the first guiding element 205 and the first positioning parts 206 form a linear path to control the relative movement and facilitate direction changing of the exerted force from an angled direction to a vertical direction, as illustrated in FIG. 7B, thus reducing the friction forces.

Additionally, the first guiding element 205, disposed between the wire contacts 201 and the piercing terminals 202, can be configured to have a top section (TS) extended in a manner to facilitate pivotal connection between the front portion 11 of the front housing 10 and the cover 40 when the terminal connection unit 20 is carried by the front housing 10. In this regard, for example, the front portion 11 is configured to have a bearing section 111 which is positioned opposite the accommodation portion 12 with a concave surface for receiving a pivot, such as a pivot section 411 of the first covering portion 41; and the bearing section 111 and the top section TS of the first guiding element 205, which has a face opposite the concave surface, form a bearing for the pivot section 411 when the terminal connection unit 20 is carried by the front housing 10, as illustrated in FIGS. 1, 3, 5B, and 6B. In other examples, a bearing section and a pivot section can be implemented in any manner on the front housing 10 and cover 40 respectively, or vice versa, with or without the aid of the first guiding element 205; that is, the bearing formed by the bearing section 111 and the top section TS as exemplified above is not to restrict the implementation of the first guiding element 205. Hence, the invention is not limited to the above examples of the pivotal connection.

Rear Housing and Grounding Bracket for Shield Integrity

The reason to utilize shielded cabling is to have better immunity to electromagnetic interference (EMI). The key point to the immunity to EMI is to have shield integrity. The following embodiments regarding the rear housing 50 and grounding bracket 55 illustrate that a shielded keystone jack according to FIG. 1 can be configured to have conductive components (e.g., metallic parts) of the jack neatly and tightly connected to the shield portion (such as the screened braid and foil) of a cable to be terminated so as to facilitate shield integrity.

Figure 8:
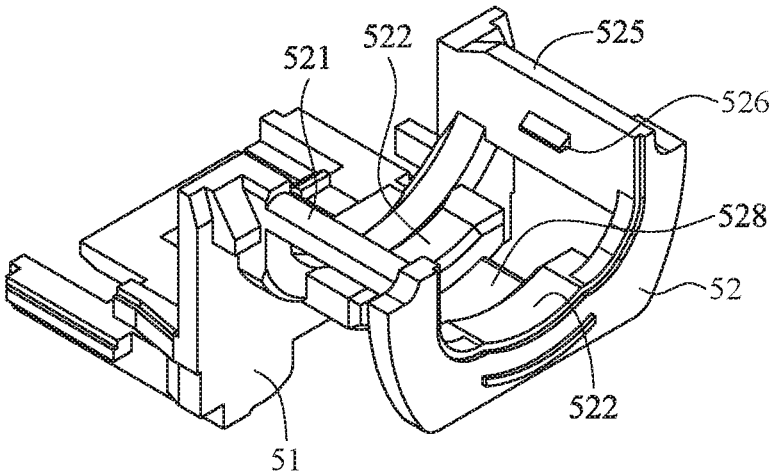
FIG. 8 is a schematic view of a rear housing according to an embodiment of the invention.

FIG. 8 is a schematic view of a rear housing 50 according to an embodiment of the invention. As illustrated in FIG. 8, the rear housing 50 includes: a cover portion 51 and a holding portion 52. The cover portion 51 is used for engagement with the front housing 10 so as to cover at least one side of the terminal connection unit 20 carried by the front housing 10. The holding portion 52, connected to the cover portion, is used for holding the cable to be terminated.

Figure 9:
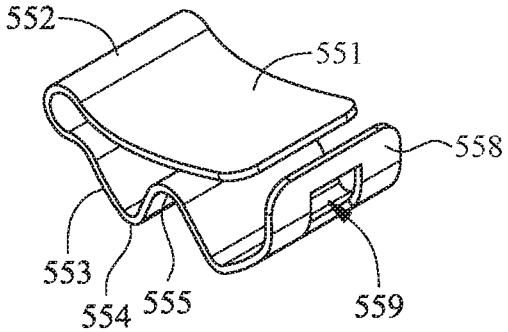
FIG. 9 is a schematic view of a grounding bracket according to an embodiment of the invention.

FIG. 9 is a schematic view of a grounding bracket 55 according to an embodiment of the invention. The grounding bracket 55 can be pivotally connected to the rear housing 50 and is used for electrically connecting to a shield portion of the cable to be terminated, wherein the grounding bracket 55 is conductive and resilient. The grounding bracket 55 includes: a grounding contact surface 551, a bearing portion 552, and a support portion 553.

The grounding contact surface 551 is used for connection to the shield portion of the first cable. The bearing portion 552, extending from the grounding contact surface 551 and being curved, is used for being pivotally connected to the rear housing 50. The support portion 553 extends from the bearing portion 552 and is shaped into folds, for example, in a zigzag shape or a W-like shape. The support portion 553 is used for being in contact with the rear housing 50 to exert a force on the grounding contact surface 551 inwards. In addition, the grounding bracket 55 can further include: a motion limiting portion 558 for engaging with the rear housing 50. For example, the motion limiting portion 558 extends from the support portion 553 and has a slot 559 for engaging with the rear housing 50.

Referring to FIGS. 8 and 9, the holding portion 52 of the rear housing 50 has: a pivot 521, a support surface 522, and a wall 525. The pivot 521 is used for making a pivot connection with the bearing portion 552. For example, the pivot 521 can be in a shape of a column, a cylinder, or a truncated cylinder, positioned on one side of the holding portion 52. The support surface 522 is used for being in contact with the support portion 553. The wall 525 is employed for being in contact with the support portion 553, or the motion limiting portion 558. In addition, a protrusion 526 can be formed on the wall 525 for engaging with the slot 559 of the motion limiting portion 558 to control motion of the grounding bracket 55 with respect to the pivot connection.

Further, the holding portion 52 further has a groove 528 across the support surface 522 in order for a fastener 60, such as a cable tie or so on, to pass the groove 528 and fasten the holding portion 52 and the cover 40 so that the shield portion 95 of the shielded cable 90 is connected to the grounding bracket 55 securely.

Referring to FIGS. 1, 8, and 9, the cover 40 and the rear housing 50 are rigid and the grounding bracket 55 is resilient. When the grounding bracket 55 is installed on the rear housing 50, the resiliency of the grounding bracket 55 makes it adjustable to cables of various sizes.

Figure 10A:
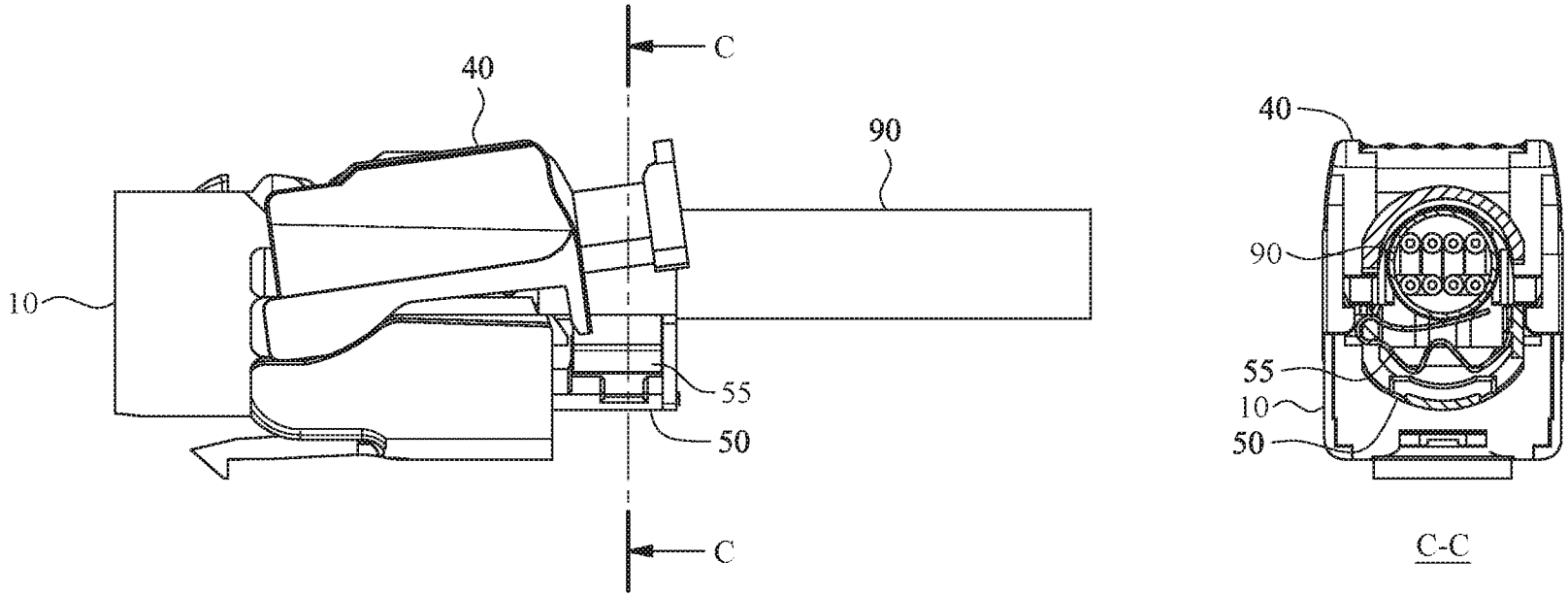
FIGS. 10A-10B are schematic views of a shielded keystone jack to which a solid 23AWG cable is terminated as the cover is pivoted from an intermediate position to a closed position.
Figure 10B:
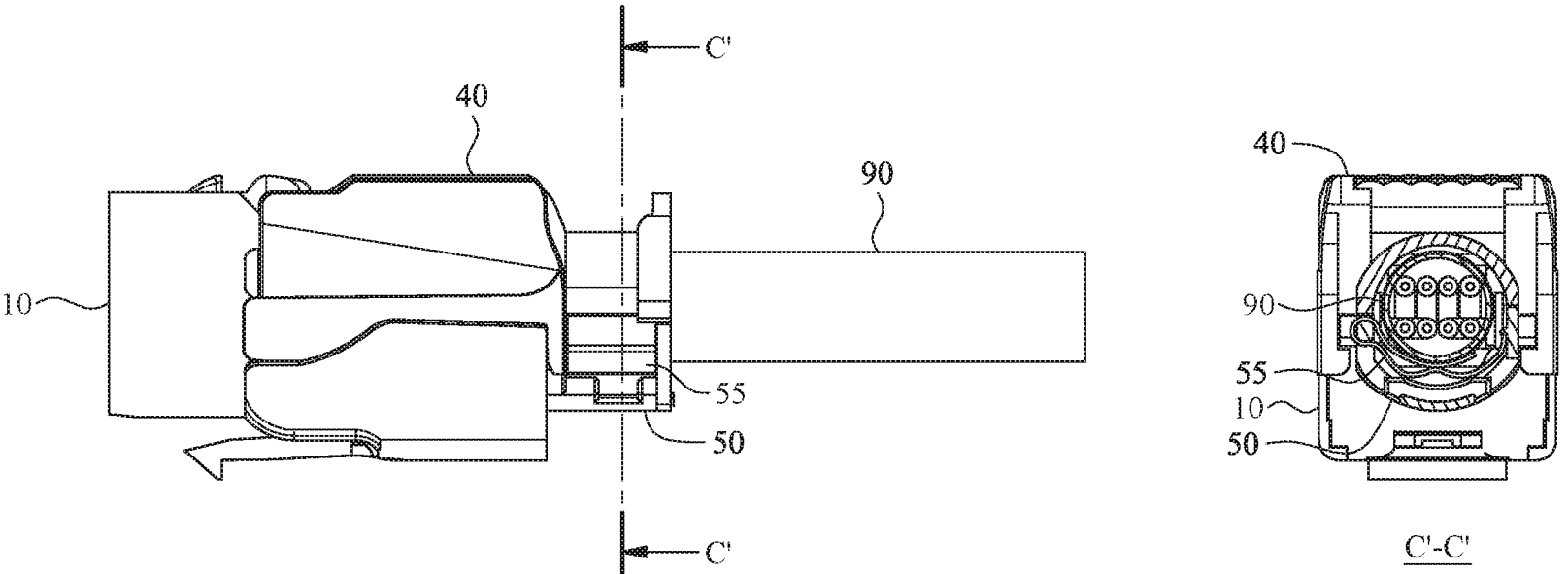

For Category 6A shielded horizontal cabling, normally solid 23AWG cables are used. The diameter of the solid 23AWG cable is approximately 10 mm. FIGS. 10A-10B are schematic views of a shielded keystone jack according to FIG. 1 to which a solid 23AWG cable is terminated when the cover 40 is pivoted from an intermediate position to a closed position, wherein cross-sectional views taken along line C-C and line C'-C' from the left sides of FIGS. 10A and 10B are shown on the right sides thereof, respectively. When the solid 23AWG cable is terminated as the cover 40 is pivoted to the closed position, as in FIG. 10B, the grounding contact surface 551 of the grounding bracket 55 rotates clockwise to adjust itself to suit the outer diameter of the solid 23AWG cable. The grounding contact surface 551 deforms and tightly touches the screened braid of the cable.

Figure 11A:
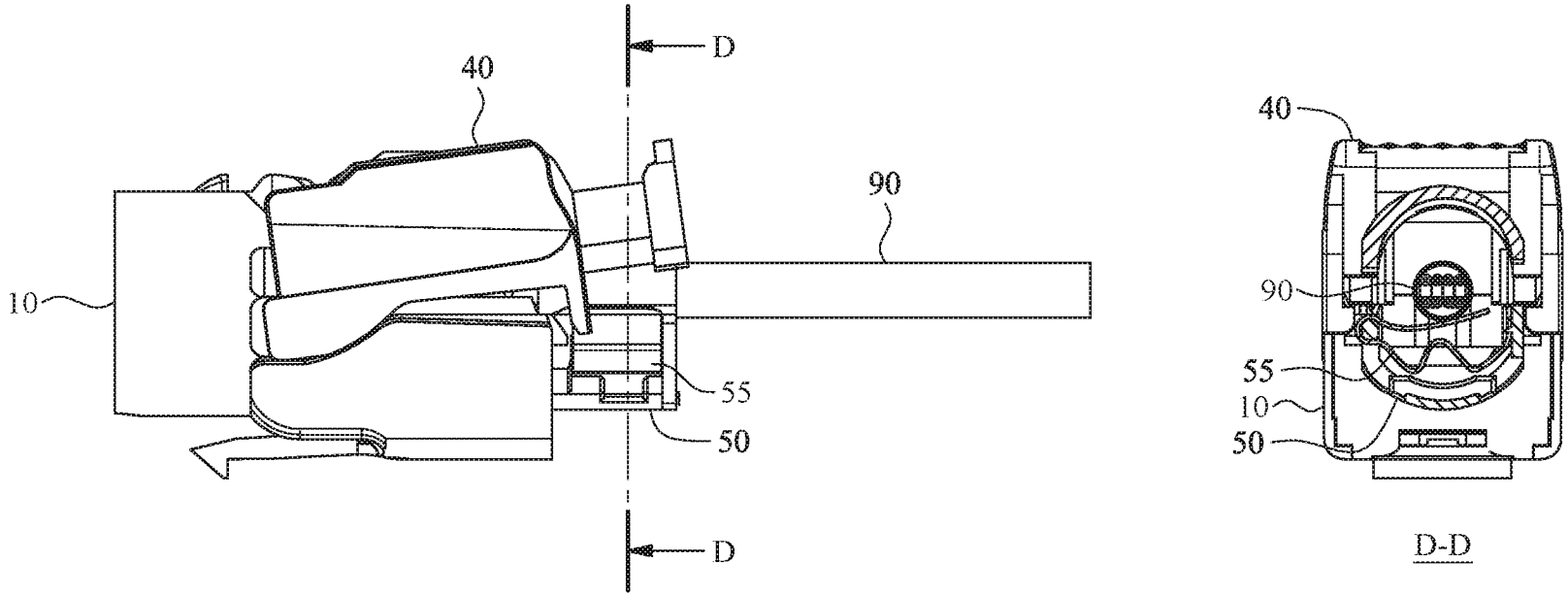
FIGS. 11A-11B are a schematic view of a shielded keystone jack to which a stranded 26AWG cable is terminated as the cover is pivoted from an intermediate position to a closed position.
Figure 11B:
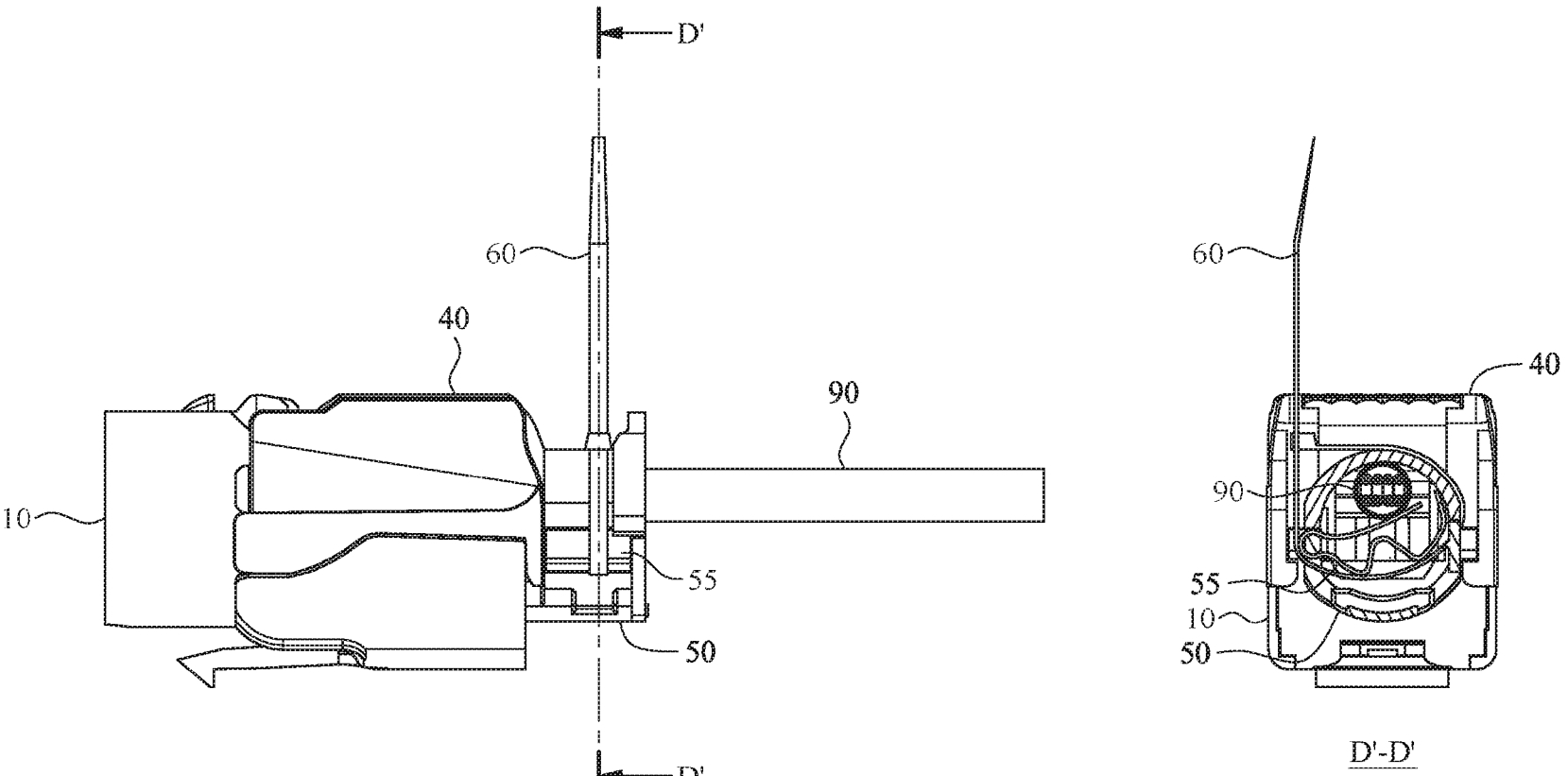

In telecommunication room, stranded 26AWG cables are used sometimes. This kind of cable has one end terminated with modular plug and the other end to be terminated with the shielded keystone jack. The diameter of stranded 26AWG cable is approximately 6 mm. FIGS. 11A-11B are schematic views of the shielded keystone jack according to FIG. 1 to which a stranded 26AWG cable is terminated when the cover 40 is pivoted from an intermediate position to a closed position, wherein cross-sectional views taken along line D-D and line D'-D' from the left sides of FIGS. 11A and 11B are shown on the right sides thereof, respectively. When the stranded 26AWG cable is terminated as the cover 40 is pivoted to the closed position, the grounding bracket 55 may barely touch the screened braid of the cable. As illustrated in FIG. 11B, the grounding bracket 55 and the screened braid of the cable can be further secured by applying a fastener 60 such as a cable tie to the shielded keystone jack to pass the groove 528 across the support surface 522 and fasten the holding portion 52 and the cover 40 so that the shield portion 95 of the shielded cable 90 is connected to the grounding bracket 55 securely. As shown in FIGS. 9 and 11B, a fulcrum 554 of the grounding bracket 55 is made to touch the fastener 60 and is enforced to lever, and makes a supporting rib 555 move upwards and elevate the grounding contact surface 551 relatively by stress when the grounding bracket 55 is secured with the fastener 60. Hence, the grounding contact surface 551 is enforced to tightly touch the screen braid as well.

Wire Retention of the Wire Organizer

Figure 12A:
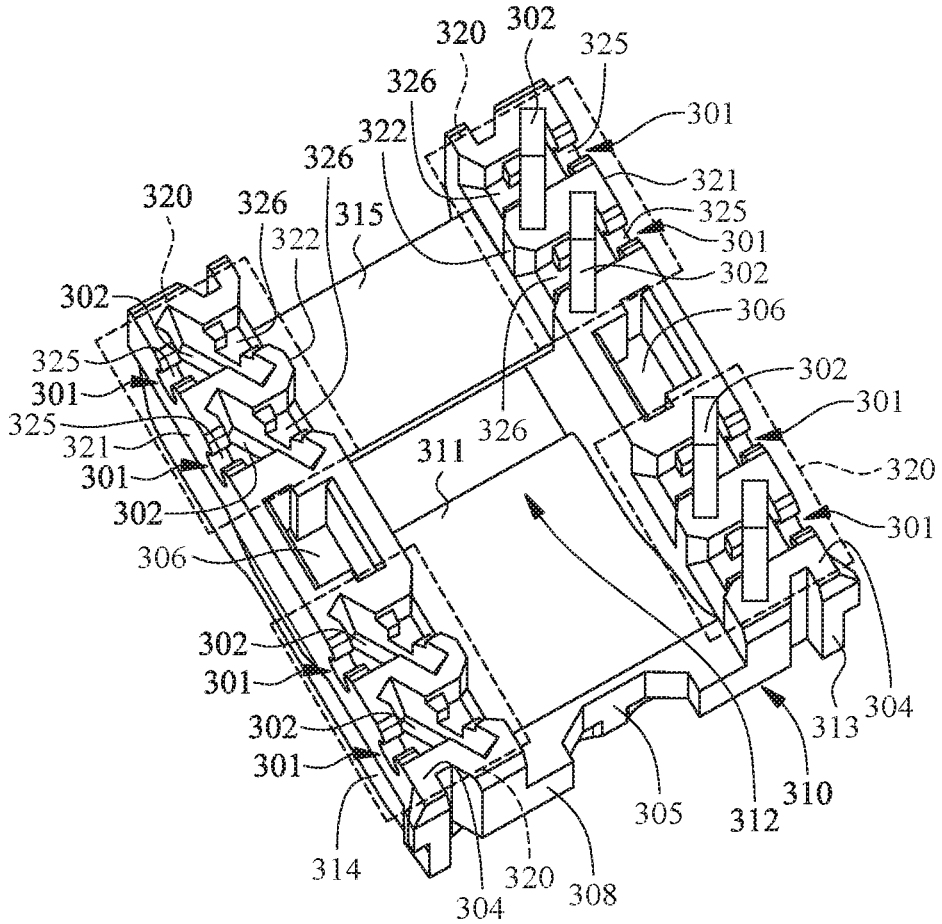
FIG. 12A is a perspective view of a wire organizer according to an embodiment of the invention.

FIG. 12A is a perspective view of a wire organizer 30 according to an embodiment of the invention. As illustrated in FIG. 12A, a wire organizer 30 comprises: a wire-receiving body 310 and a plurality of wire-receiving portions 320. The wire-receiving body 310 includes a cover portion 311, two lateral portions 313 and 314, and a connection plate 315. The lateral portions 313 and 314 are connected laterally to both sides of the cover portion 311, providing a cavity 312 for receiving the wires to be terminated. The plurality of wire-receiving portions 320 are coupled to lateral sides of the wire-receiving body 310. Each of the wire-receiving portions 320 has at least one of the wire-receiving slots 301. In FIG. 12A, the wire-receiving portions 320 has two wire-receiving slots 301, for example.

Referring to FIG. 12A, the wire-receiving portion 320 is depicted in detail for the sake of illustration. Each of the wire-receiving slots 301 is open to a peripheral side 304 (i.e., open upwards on FIG. 12A) of the corresponding wire-receiving portion 320 and has a first end 325 and a second end 326 on an outer face 321 and an inner face 322 of the corresponding wire-receiving portion 320, respectively. The outer face 321 is opposite the inner face 322.

In an embodiment, the first end 325 has a spacing (e.g., width or diameter) which is different from that of the second end 326 so as to facilitate accommodation of the wire of cables of various cable gauges.

In another embodiment, the first end 325 and second end 326 of the wire-receiving slot 301 can be configured in different shapes so as to facilitate accommodation of one of the wires of cables of various cable gauges.

Figure 12B:
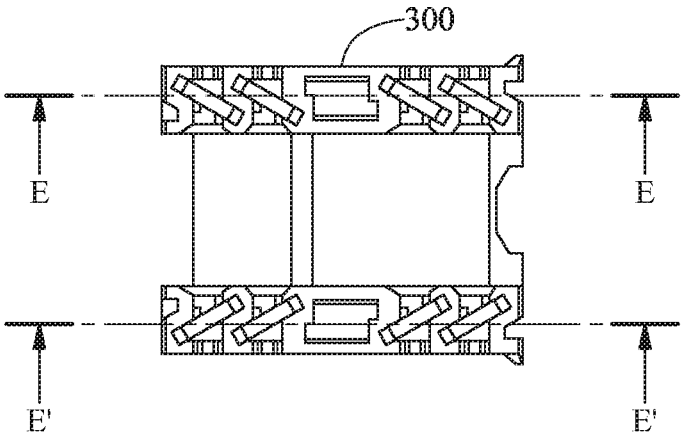
FIG. 12B is a top view of the wire organizer according to an embodiment of the invention.
Figure 12C:
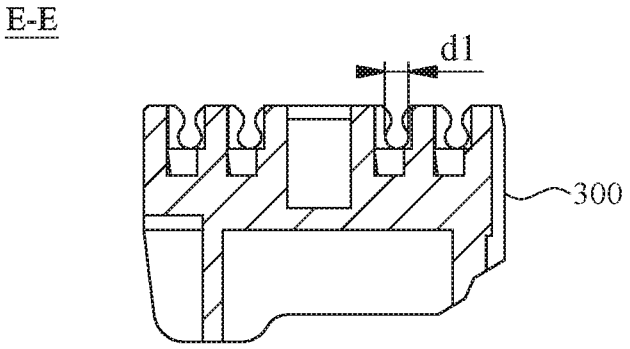
FIGS. 12C-12D are cross-sectional views of the wire organizer according to an embodiment of the invention.
Figure 12D:
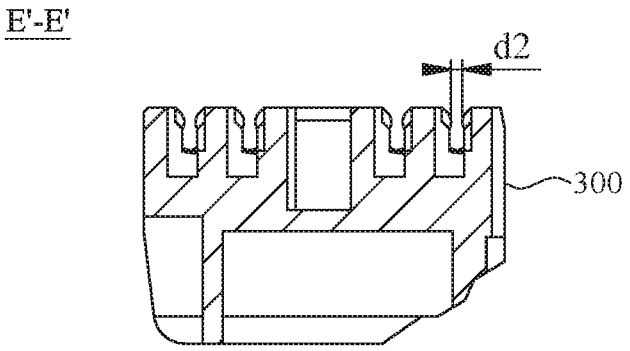

FIG. 12B is a top view of the wire organizer 30 of FIG. 12A according to an embodiment of the invention. FIGS. 12C-12D are cross-sectional views of the wire organizer 30 of FIG. 12A according to an embodiment along line E-E and line E'-E' respectively. In an example, the first end 325 of the wire-receiving slot 301 is an omega-shaped opening (i.e., similar to a center opening of the symbol Ω) with a spacing of d1 (e.g., effective diameter), as shown in FIG. 12C. In another example, the second end 326 is a canyon-shaped opening (e.g., a continuous recessed opening with columns, which may have circular or rectangular cross sections, protruding from the bottom of the recessed opening) with a spacing of d2 (e.g., effective width), as shown in FIG. 12D. In some examples, the second end 326 can be configured in a tapered or stepped shape, either symmetrical or non-symmetrical.

In some examples, the spacing of d1 and d2 may be implemented in the same or different spacing, and/or the shapes of the first end 325 and second end 326 of the wire-receiving slot 301 may be implemented in the same or different shapes, depending on the requirement for the shielded keystone jacks.

For example, a shielded keystone jack according to FIGS. 1 and 12A-12D is configured to terminate a cable such as a solid 23AWG cable or stranded 26AWG cable. In this example, the four twisted-pair wires of the cable are to be retained at the wire organizer 30 securely without displacement; otherwise, connection failure might occur if the wires become loose during the termination to the piercing terminals 202. Hence, the wire organizer 30 provides a two-gate retention (or called two-level retention) in order to accommodate various cables of different wire gauges.

It is given that the diameter of solid 23AWG wire is approximately 1.5 mm, and the diameter of stranded 26AWG wire is approximately 1.1 mm. In this example, the first end 325 on the outer face 321 is a-shaped with a spacing d1 of 1.1 mm so as to provide suitable wire retention for a solid 23AWG wire. On the other hand, the second end 326 on the inner face 322 is canyon-shaped with a spacing d2 of 0.7 mm so as to provide suitable wire retention for a stranded 26AWG wire.

When a solid 23AWG wire is placed, it has about a half of friction at edges of the inner face 322 and a third of the friction at edges of the outer face 321. When a stranded 26AWG wire is placed, it has about a third of friction at edges of the inner face 322 and a few of the friction at edges of the outer face 321. Hence, the shielded keystone jack of this example is capable of terminating a solid 23AWG cable or stranded 26AWG cable, thereby balancing friction and tightness and facilitating cable termination for the users. In addition, the implementation of the invention is not limited to this example.

Further, for cable termination, the wire organizer 30 according to FIG. 12A has terminal slots 302 for accommodating the piercing terminals 202 correspondingly disposed on the terminal connection unit 20. For example, a terminal slot 302 is positioned in the wire organizer 30 and intersects with a wire-receiving slot 301 at an angle, and thus the wire organizer 30 can be realized in a more compact size than that with the terminal slots intersecting with the wire-receiving slots 301 vertically. However, the implementation of the invention is not limited to this example; and the intersections can be made at any suitable same or respective angle(s).

Air-Tight Combination for EMI Immunity Enhancement

In the following, embodiments of a shielded keystone jack according to FIG. 1 are provided to illustrate air-tight combination for EMI immunity enhancement. In the embodiments, the cover 40, front housing 10, and rear housing 50 are conductive and rigid, such as metallic or die-cast components, in part or whole; and the grounding bracket 55 is conductive and resilient. On the other hand, the terminal connection unit 20, at least in part, includes resilient components, such as plastic parts. As will be illustrated in FIGS. 13-18B, the rigid components can be tightly secured by using resilient components therebetween collaboratively, thereby achieving air-tight protection and reducing EMI leakage that reduces EMI immunity.

Figure 13:
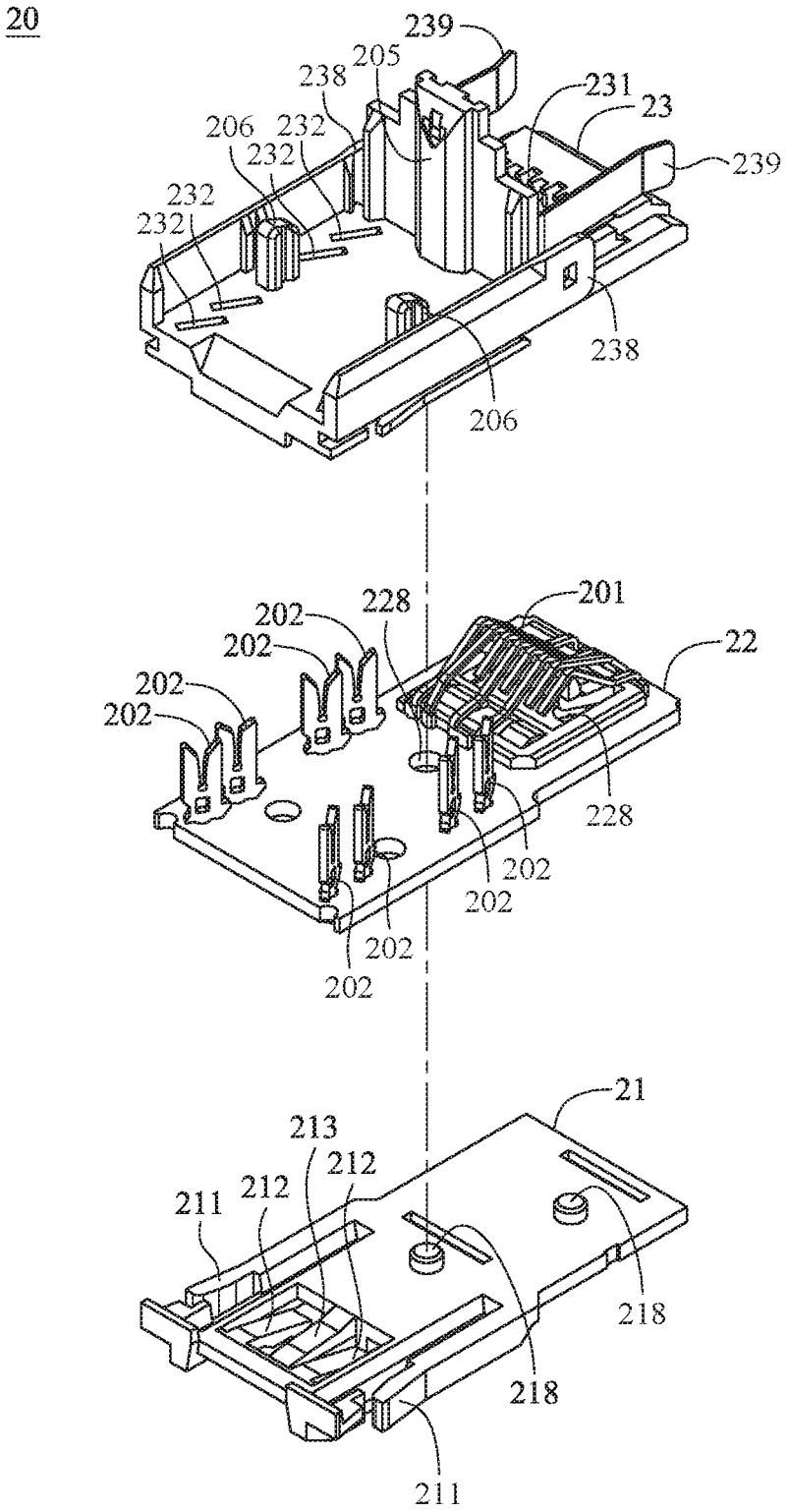
FIG. 13 is a schematic view of a terminal connection unit according to an embodiment of the invention.

FIG. 13 is a schematic view of a terminal connection unit 20 according to an embodiment of the invention. In FIG. 13, the terminal connection unit 20 includes: an insulation base 21, a circuit board 22, and a terminal connection housing 23. The circuit board 22 is disposed on the insulation base 21. The wire contacts 201 and the piercing terminals 202 are disposed on the circuit board 22. The terminal connection housing 23 is used for covering the circuit board 22 partially. The first guiding element 205 and the first positioning parts 206 are disposed on the terminal connection housing 23. The terminal connection housing 23 has openings, for example, 231 and 232, through which the wire contacts 201 and the piercing terminals 202 are exposed at least partially. The insulation base 21 has resilient components, for example, securing arms, such as, 211, 212, and 213, for engaging with the rigid components, such as at least one of the front housing 10 and rear housing 50. The terminal connection housing 23, for example, may have resilient components, such as securing arms 238 or grounding latches 239, for engaging with the rigid component, such as the front housing 10. In some examples, male and female parts (e.g., protrusions 218 and openings 228) or any mating parts may be implemented on any two of the insulation base 21, circuit board 22, and terminal connection housing 23 for engagement and securing.

According to an embodiment, the assembly process is as follows. The circuit board 22 is fixed with the terminal connection housing 23 and insulation base 21 for the terminal connection unit 20. The terminal connection unit 20 is fixed with the front housing 10 and cover 40, as illustrated in FIGS. 14A-15B. The rear housing 50 is then fixed with the insulation base 21 which is fixed with the front housing 10, as illustrated in FIGS. 16A-17B.

Figure 14A:
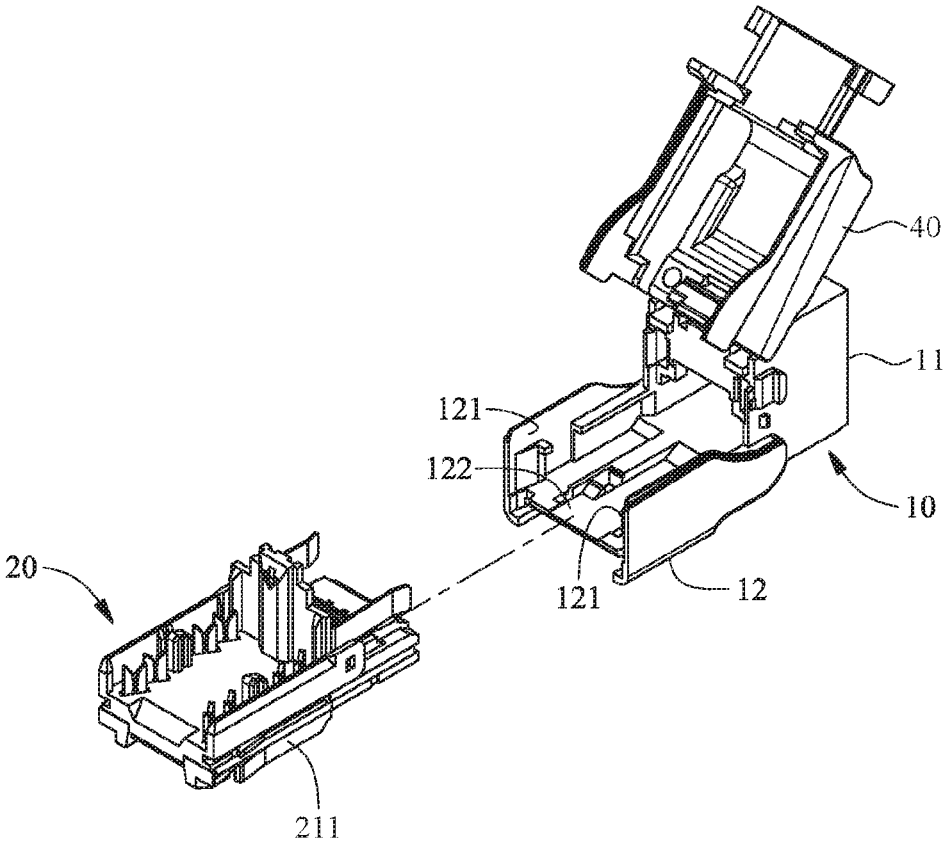
FIGS. 14A-14B are schematic views of assembly process of a shielded keystone jack according to an embodiment of the invention.
Figure 14B:
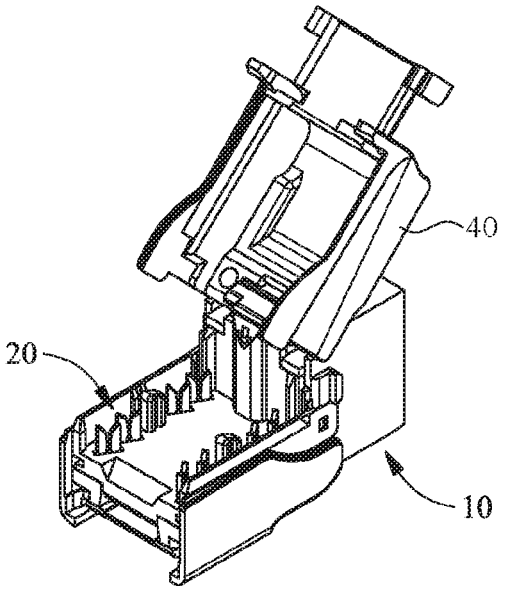

Referring to FIGS. 14A-14B, the terminal connection unit 20 is fixed with the front housing 10 according to an embodiment of the invention. As in FIG. 14A, the terminal connection unit 20 can be inserted into the front housing 10 and fixed by at least one securing arm 211 which is resilient and for engaging with an interior sidewall 121 of the accommodation portion 12 of the front housing 10 so as to secure the insulation base 21 to the front housing 10. In addition, the interior sidewall 121 may have a protrusion or opening, for example, so as to engage with the securing arm 211 for securing.

Figure 15A:
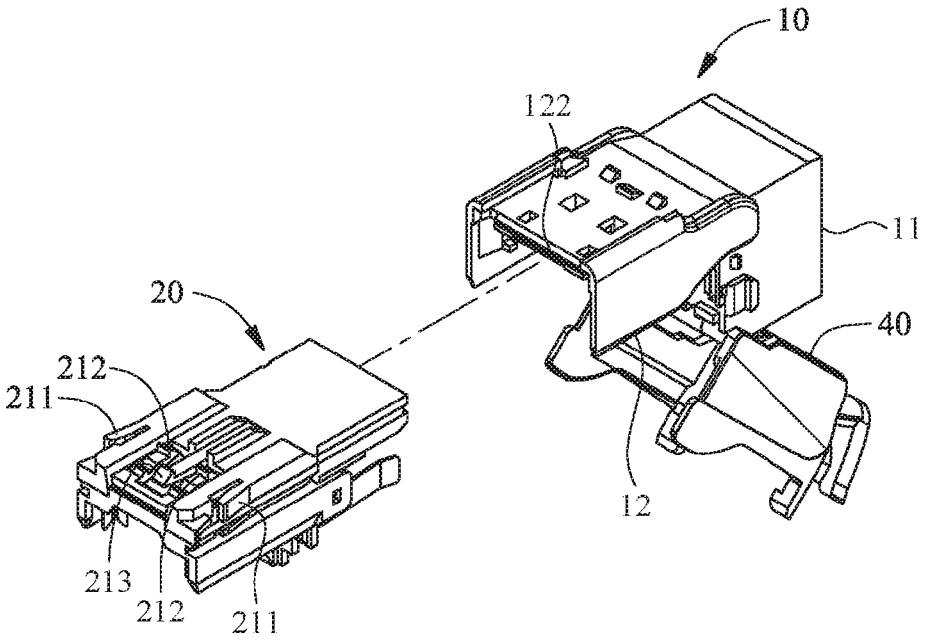
FIGS. 15A-15B are schematic views of assembly process of a shielded keystone jack according to an embodiment of the invention.
Figure 15B:
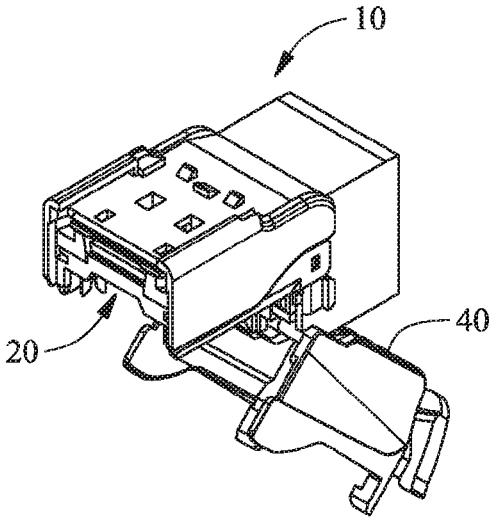

Referring to FIGS. 15A-15B, the terminal connection unit 20 is fixed with the front housing 10 according to an embodiment of the invention. As in FIG. 15A, the insulation base 21 has at least one securing arm 212 which is resilient and for engaging with a bottom plate 122 of the front housing 10 so as to secure the insulation base 21 to the front housing 10. In addition, the bottom plate 122 may have a protrusion or opening, for example, so as to engage with the securing arm 212 for securing.

Figure 16A:
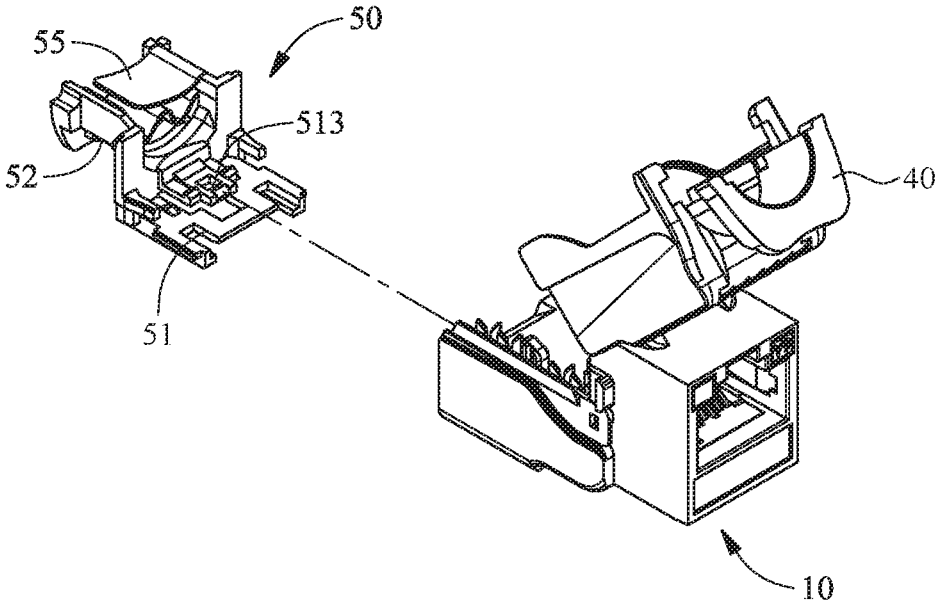
FIGS. 16A-16B are schematic views of assembly process of a shielded keystone jack according to an embodiment of the invention.
Figure 16B:
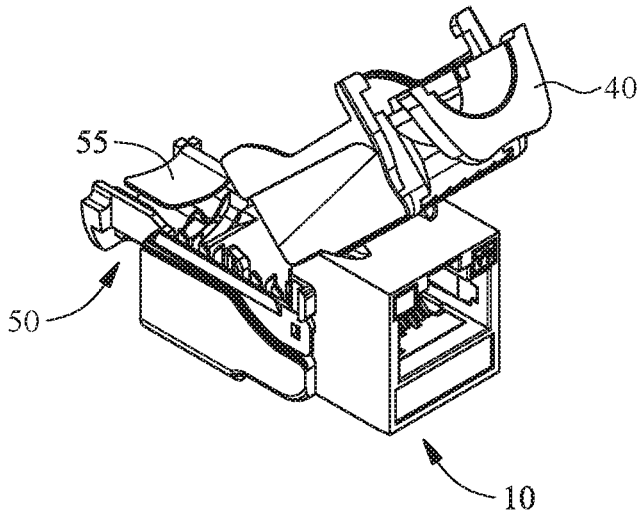

Referring to FIGS. 16A-16B, the rear housing 50 is fixed with the insulation base 21 which is fixed with the front housing 10. As in FIGS. 15A and 16A, the insulation base 21 has at least one securing arm 213 which is resilient and for engaging with the rear housing 50 so as to secure the rear housing 50 to the insulation base 21. In addition, the cover portion 51 of the rear housing 50 may have an opening 513 or protrusion, for example, so as to engage with the securing arm 213 for securing. Further, the cover portion 51 of the rear housing 50 may have a protrusion or opening, for example, so as to engage with the securing arm 212 for securing. Alternatively or additionally, in some examples, male and female parts or any mating parts may be implemented on the cover portion 51 and the rear housing 50 for engagement and securing. In addition, as illustrated in FIG. 16A, a grounding bracket 55 according to FIG. 9 is installed on the rear housing 50.

Figure 17A:
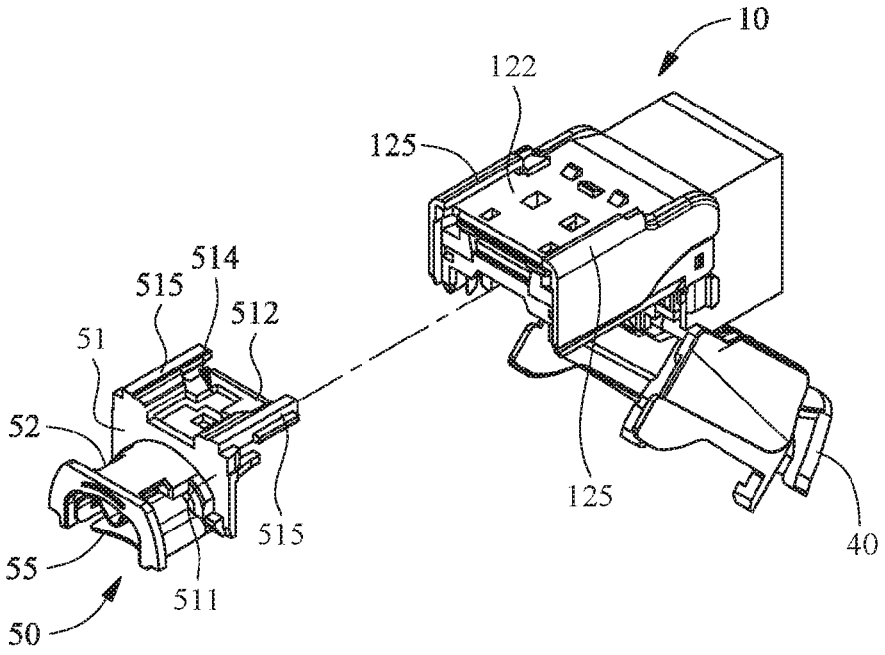
FIG. 17A-17B are schematic views of assembly process of a shielded keystone jack according to an embodiment of the invention.
Figure 17B:
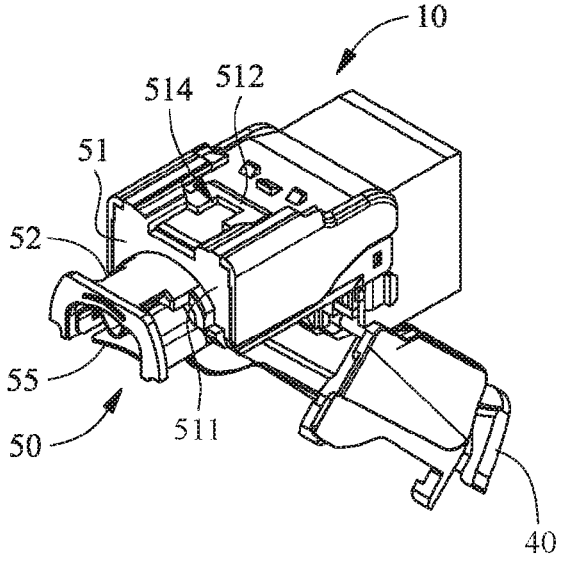

Referring to FIG. 17A-17B, the rear housing 50 is fixed with the insulation base 21 which is fixed with the front housing 10 according to an embodiment of the invention. As in FIG. 17A, the cover portion 51 includes a first cover section 511 and a second cover section 512. The first cover section 511 covers the rear side of the terminal connection unit 20 while the second cover section 512 covers the bottom plate 122, which may have openings, after the rear housing 50 is inserted into the front housing 10, as shown in FIG. 17B. In this way, air-tight protection is enhanced. In some examples, the insertion of the rear housing 50 into the front housing 10 may be realized by configuration of the accommodation portion 12 of the front housing 10 and the second cover section 512 with at least one groove and at least one sliding member, such as grooves 125 of the accommodation portion 12 and sliding sections 515 of the rear housing 50. However, the invention is not limited thereto.

Figure 18A:
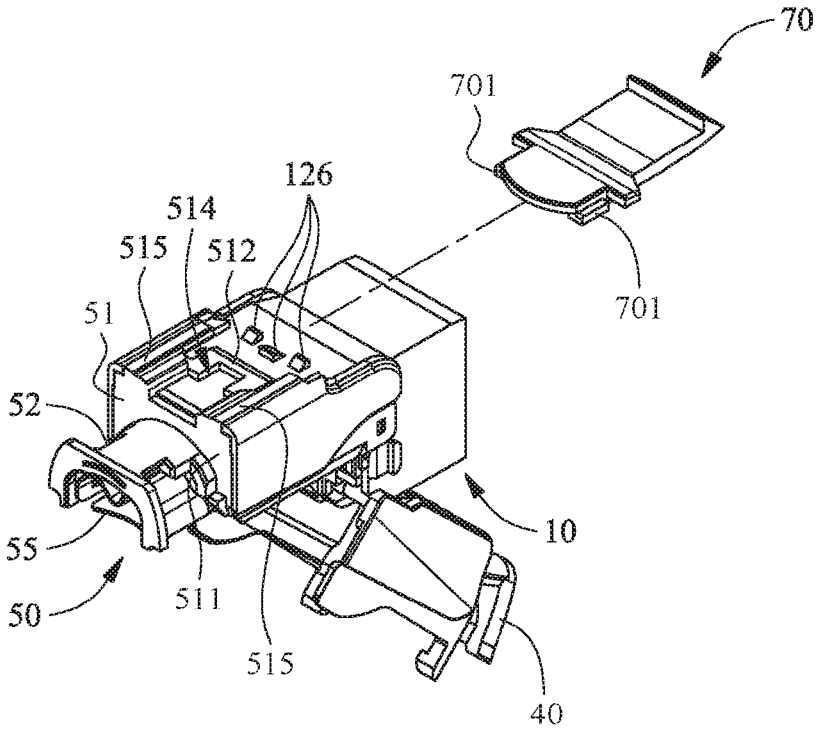
FIGS. 18A-18B are schematic views of assembly process of a shielded keystone jack according to an embodiment of the invention.
Figure 18B:
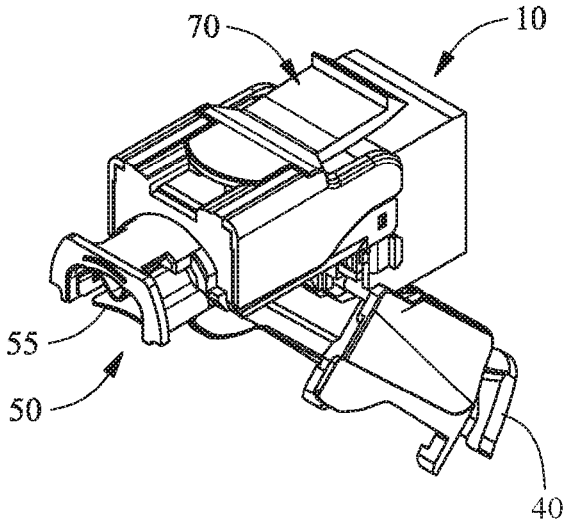

Referring to FIGS. 18A-18B, a resilient latch 70 can be further fixed with the front housing 10 and rear housing 50 according to an embodiment of the invention. As in FIG. 18A, the resilient latch 70 is configured to engage with one or more protrusions 126 formed on an outer face of the bottom plate 122 and an opening 514 formed on the second cover section 512. In addition, the resilient latch 70 has protrusions such as tabs 701 which engage with grooves formed on the inner sides of the sliding sections 515. In this way, the combination as shown in FIG. 18B with the wire organizer attached to wires of a shield cable to be terminated can be inserted into a patch panel securely through the resilient latch 70. However, the invention is not limited to the example regarding the resilient latch 70.

For a shielded keystone jack, transfer impedance and coupling attenuation, among others, are two key parameters indicating the electromagnetic interference immunity.

Figure 19:
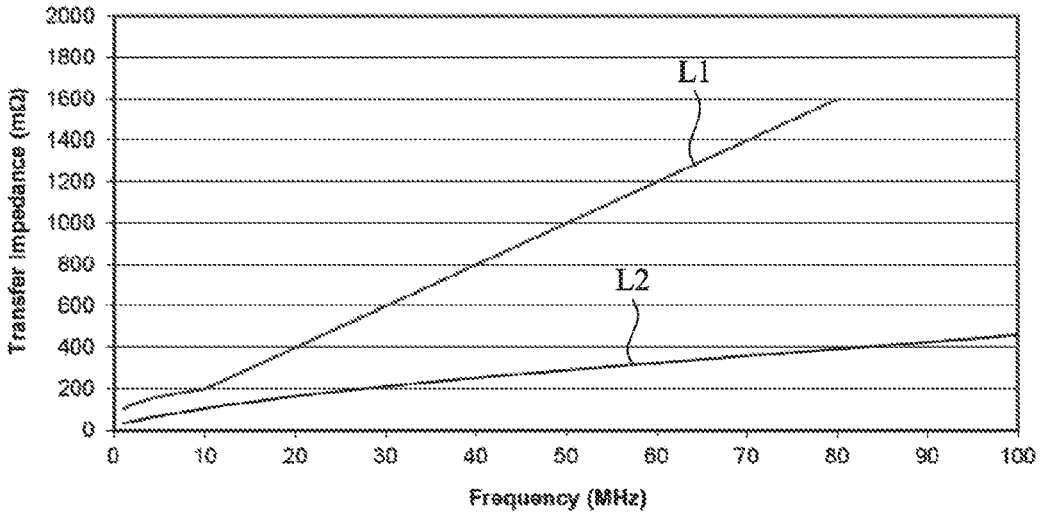
FIG. 19 is a graph of transfer impedance performance of a shielded keystone jack according to an embodiment of the invention.

In an example, FIG. 19 is a graph showing shield effectiveness with respect to a shielded keystone jack in which the resilient latch 70 is fixed with the rear housing 50 and the front housing 10, as in FIG. 18B, with ingress and egress of interfering signals by way of measurement of the transfer impedance over lower frequencies (less than 1 GHz). In FIG. 19, curve L1 indicates the limit of a requirement by international standard organization (ISO) and curve L2 indicates the transfer impedance of the shielded keystone jack. As can be observed in FIG. 19, the transfer impedance for the shielded keystone jack is much lower than the limit required.

Figure 20:
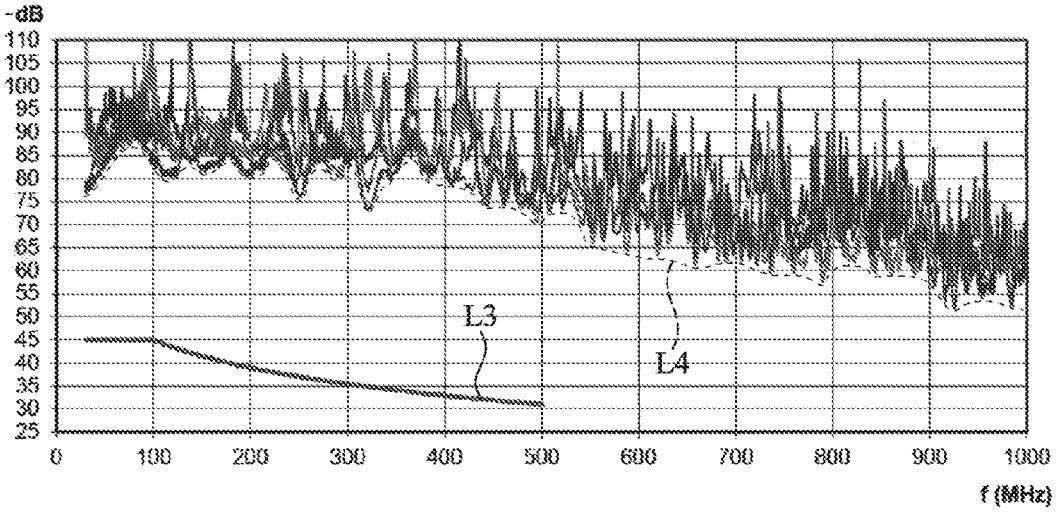
FIG. 20 is a graph of coupling attenuation performance of a shielded keystone jack according to an embodiment of the invention.

In another example, FIG. 20 is graph illustrating coupling attenuation by measurement of both noise emission and noise immunity performance of a shielded keystone jack according to an embodiment of the invention. In FIG. 20, curve L3 indicates the limit of a requirement by international standard organization (ISO) and curve L4 (i.e., a dotted line) indicates an envelope representing the complicated curves corresponding to the coupling attenuation of the wires terminated to the shielded keystone jack. As can be observed in FIG. 20, the coupling attenuation for the shielded keystone jack is much lower than the limit required.

FIGS. 19 and 20 show that the air-tight configuration according to an embodiment of the invention contributes shield integrity that exhibits enhanced EMI immunity.

While certain embodiments have been described and shown in the accompanying drawings, it is to be understood that such embodiments are merely illustrative of and not restrictive on the broad invention, and that the invention is not limited to the specific constructions and arrangements shown and described, since numerous modifications and variations could be made thereto by those skilled in the art without departing from the scope and spirit of the invention set forth in the claims.

What is claimed is:

1. A shielded keystone jack structure for connection of a plurality of wires of a first cable to be terminated to a second cable, the shielded keystone jack structure comprising:

a front housing including a front portion and an accommodation portion, the front portion having an opening for insertion of the second cable;

a terminal connection unit having a plurality of wire contacts, a plurality of piercing terminals electrically coupled to the respective wire contacts, a first guiding element, and a plurality of first positioning parts arranged among the piercing terminals, wherein the wire contacts are disposed on the front portion and the piercing terminals are disposed on the accommodation portion when the terminal connection unit is carried by the front housing;

a wire organizer having a plurality of wire-receiving slots for attachment of the plurality of wires thereto;

a cover, pivotally connectable to the front housing, wherein the wire organizer, when being disposed on the terminal connection unit carried by the front housing, is moved towards the piercing terminals along a path at least defined by the first guiding elements and the first positioning parts so that the wires attached to the wire organizer are terminated to the respective piercing terminals when the cover is pivoted from an open position to a closed position; and a rear housing for being attached to the front housing so as to cover at least one side of the terminal connection unit carried by the front housing.

2. The shielded keystone jack structure according to claim 1, wherein the first guiding element is disposed between the wire contacts and the piercing terminals, and at least two of the first positioning parts are disposed adjacent to opposite lateral sides of the terminal connection unit.

3. The shielded keystone jack structure according to claim 1, wherein the first guiding element is disposed between the wire contacts and the piercing terminals and has a top section; the front portion of the front housing has a bearing section; the bearing section and the top section form a bearing for pivotal connection between the cover and the front housing when the terminal connection unit is carried by the front housing.

4. The shielded keystone jack structure according to claim 1, wherein the wire organizer further has: a second guiding element for engaging with the first guiding element; and a plurality of second positioning parts for engaging with the first positioning parts.

5. The shielded keystone jack structure according to claim 1, wherein the wire organizer comprises:

a wire-receiving body having a cavity for receiving the wires to be terminated; and a plurality of wire-receiving portions, coupled to lateral sides of the wire-receiving body, each of the wire-receiving portions having at least one the wire-receiving slots;

wherein each of the wire-receiving slots is open to a peripheral side of the corresponding wire-receiving portion and has a first end and a second end on an outer face and an inner face of the corresponding wire-receiving portion, respectively, the outer face is opposite the inner face, and the first end has a spacing which is different from that of the second end so as to facilitate accommodation of one of the wires.

6. The shielded keystone jack structure according to claim 5, wherein the wire organizer further comprises:

a second guiding element, disposed on the wire-receiving body, for engaging with the first guiding element; and a plurality of second positioning parts, coupled to the lateral sides of the wire-receiving body, for engaging with the first positioning parts.

7. The shielded keystone jack structure according to claim 1, wherein one of the wire-receiving slots is open to a peripheral side of the wire organizer and has a first end and a second end on an outer face and an inner face of the wire organizer, respectively, the outer face is opposite the inner face, and the first end has a spacing which is different from that of the second end so as to facilitate accommodation of one of the wires.

8. The shielded keystone jack structure according to claim 7, wherein the first end is an omega-shaped opening.

9. The shielded keystone jack structure according to claim 7, wherein the second end is a canyon-shaped opening.

10. The shielded keystone jack structure according to claim 1, wherein the terminal connection unit includes:

an insulation base;

a circuit board, disposed on the insulation base, wherein the wire contacts and the piercing terminals are disposed on the circuit board; and a terminal connection housing for covering the circuit board partially, wherein the first guiding element and the first positioning parts are disposed on the terminal connection housing and the terminal connection housing has openings through which the wire contacts and the piercing terminals are exposed at least partially.

11. The shielded keystone jack structure according to claim 10, wherein the insulation base has a first securing arm which is resilient and for engaging with an interior sidewall of the accommodation portion of the front housing so as to secure the insulation base to the front housing.

12. The shielded keystone jack structure according to claim 10, wherein the insulation base has a second securing arm which is resilient and for engaging with a bottom plate of the front housing so as to secure the insulation base to the front housing.

13. The shielded keystone jack structure according to claim 10, wherein the insulation base has a third securing arm which is resilient and for engaging with the rear housing so as to secure the rear housing to the insulation base.

14. The shielded keystone jack structure according to claim 10, wherein the first guiding element is disposed between the wire contacts and the piercing terminals on the terminal connection housing and has a top section; the front portion of the front housing has a bearing section; the bearing section and the top section form a bearing for pivotal connection between the cover and the front housing when the terminal connection unit is carried by the front housing.

15. The shielded keystone jack structure according to claim 1, further comprising:

a grounding bracket, pivotally connected to the rear housing, for electrically connecting to a shield portion of the first cable, wherein the grounding bracket is conductive and resilient.

16. The shielded keystone jack structure according to claim 15, wherein the grounding bracket includes:

a grounding contact surface for connection to the shield portion of the first cable;

a bearing portion, extending from the grounding contact surface and being curved, for being pivotally connected to the rear housing; and a support portion, extending from the bearing portion and shaped into folds, for being in contact with the rear housing to exert a force on the grounding contact surface inwards.

17. The shielded keystone jack structure according to claim 16, wherein the grounding bracket further includes:

a motion limiting portion, extending from the support portion, having a slot for engaging with the rear housing.

18. The shielded keystone jack structure according to claim 17, wherein the rear housing includes:

a cover portion for engagement with the front housing so as to cover at least one side of the terminal connection unit carried by the front housing; and a holding portion, connected to the cover portion, having:

a pivot for making a pivot connection with the bearing portion, a support surface for being in contact with the support portion, and a protrusion for engaging with the slot of the motion limiting portion to control motion of the grounding bracket with respect to the pivot connection.

19. The shielded keystone jack structure according to claim 18, wherein the holding portion further has a groove across the support surface in order for a fastener to pass the groove and fasten the holding portion and the cover so that the shield portion of the first cable is connected to the grounding bracket securely.

* * * * *